US007967927B2

(12) United States Patent
Kuehmann et al.

(10) Patent No.: US 7,967,927 B2
(45) Date of Patent: Jun. 28, 2011

(54) NANOCARBIDE PRECIPITATION STRENGTHENED ULTRAHIGH-STRENGTH, CORROSION RESISTANT, STRUCTURAL STEELS

(75) Inventors: Charles J. Kuehmann, Deerfield, IL (US); Gregory B. Olson, Riverwoods, IL (US); Herng-Jeng Jou, Wilmette, IL (US)

(73) Assignee: QuesTek Innovations, LLC, Evanston, IL (US)

( * ) Notice: Subject to any disclaimer, the term of this patent is extended or adjusted under 35 U.S.C. 154(b) by 1175 days.

(21) Appl. No.: 11/621,468

(22) Filed: Jan. 9, 2007

(65) Prior Publication Data

US 2010/0258217 A1 Oct. 14, 2010

Related U.S. Application Data

(63) Continuation of application No. 10/360,204, filed on Feb. 6, 2003, now Pat. No. 7,160,399, which is a continuation-in-part of application No. 10/071,688, filed on Feb. 8, 2002, now Pat. No. 7,235,212.

(60) Provisional application No. 60/267,627, filed on Feb. 9, 2001, provisional application No. 60/323,996, filed on Sep. 21, 2001.

(51) Int. Cl.
*C21D 8/00* (2006.01)
*C21D 6/04* (2006.01)

(52) U.S. Cl. ..... 148/542; 148/578; 148/608

(58) Field of Classification Search ..... None
See application file for complete search history.

(56) References Cited

U.S. PATENT DOCUMENTS

RE26,225 E 6/1967 Kasak et al.
(Continued)

FOREIGN PATENT DOCUMENTS

EP 0739994 A1 1/1996
(Continued)

OTHER PUBLICATIONS

European extended Search Report Application No. 10151760.5-2122 dated May 19, 2010.
(Continued)

*Primary Examiner* — George Wyszomierski
(74) *Attorney, Agent, or Firm* — Banner & Witcoff Ltd

(57) ABSTRACT

A nanocarbide precipitation strengthened ultrahigh-strength, corrosion resistant, structural steel possesses a combination of strength and corrosion resistance comprising in combination, by weight, about: 0.1 to 0.3% carbon (C), 8 to 17% cobalt (Co), 0 to 10% nickel (Ni), 6 to 12% chromium (Cr), less than 1% silicon (Si), less than 0.5% manganese (Mn), and less than 0.15% copper (Cu), with additives selected from the group comprising about: less than 3% molybdenum (Mo), less than 0.3% niobium (Nb), less than 0.8% vanadium (V), less than 0.2% tantalum (Ta), less than 3% tungsten (W), and combinations thereof, with additional additives selected from the group comprising about: less than 0.2% titanium (Ti), less than 0.2% lanthanum (La) or other rare earth elements, less than 0.15% zirconium (Zr), less than 0.005% boron (B), and combinations thereof, impurities of less than about: 0.02% sulfur (S), 0.012% phosphorus (P), 0.015% oxygen (O) and 0.015% nitrogen (N), the remainder substantially iron (Fe), incidental elements and other impurities. The alloy is strengthened by nanometer scale $M_2C$ carbides within a fine lath martensite matrix from which enhanced chemical partitioning of Cr to the surface provides a stable oxide passivating film for corrosion resistance. The alloy, with a UTS in excess of 280 ksi, is useful for applications such as aircraft landing gear, machinery and tools used in hostile environments, and other applications wherein ultrahigh-strength, corrosion resistant, structural steel alloys are desired.

67 Claims, 7 Drawing Sheets
(1 of 7 Drawing Sheet(s) Filed in Color)

CONTOURS OF $M_S$ TEMPERATURE AND $M_2C$ DRIVING FORCE (ΔG) FOR VARYING COBALT (Co) AND NICKEL (Ni) CONTENTS, WHERE TEMPERATURE HAS BEEN SET TO −80°C, AND OTHER ALLOYING ELEMENT AMOUNTS HAVE BEEN SET TO, BY WEIGHT, 0.14% C, 9% Cr, 1.5% Mo, AND 0.5% V

U.S. PATENT DOCUMENTS

| | | | | |
|---|---|---|---|---|
| 3,756,808 | A | 9/1973 | Webster | |
| 3,873,378 | A | 3/1975 | Webster | |
| 4,585,479 | A | 4/1986 | Aoki et al. | |
| 4,836,869 | A | 6/1989 | Olson et al. | |
| 4,846,904 | A | 7/1989 | Arai et al. | |
| 4,902,472 | A | 2/1990 | Isobe et al. | |
| 5,017,246 | A | 5/1991 | Miyasaka et al. | |
| 5,049,210 | A | 9/1991 | Miyasaka et al. | |
| 5,061,440 | A | 10/1991 | Watanabe et al. | |
| 5,152,848 | A | 10/1992 | Ohma | |
| 5,221,372 | A | 6/1993 | Olson | |
| 5,284,530 | A | 2/1994 | Azuma et al. | |
| 5,298,093 | A | 3/1994 | Okamoto | |
| 5,310,431 | A | 5/1994 | Buck | |
| 5,358,577 | A | 10/1994 | Uehara et al. | |
| 5,433,798 | A | 7/1995 | Takano et al. | |
| 5,672,215 | A | 9/1997 | Azuma et al. | |
| 5,714,016 | A | 2/1998 | Ueda et al. | |
| 5,716,465 | A | 2/1998 | Hara et al. | |
| 5,746,845 | A | 5/1998 | Yoshida et al. | |
| 5,820,699 | A | 10/1998 | Asahi et al. | |
| 5,824,264 | A | 10/1998 | Uno et al. | |
| 5,849,111 | A | 12/1998 | Igarashi et al. | |
| 6,030,469 | A | 2/2000 | Ernst et al. | |
| 6,110,421 | A | 8/2000 | Shimizu et al. | |
| 6,117,388 | A | 9/2000 | Shibata et al. | |
| 6,129,999 | A | 10/2000 | Ueda et al. | |
| 6,146,475 | A | 11/2000 | Kosa | |
| 6,159,311 | A | 12/2000 | Amaya et al. | |
| 6,176,946 | B1 | 1/2001 | Kuehmann et al. | |
| 6,210,806 | B1 | 4/2001 | Hidaka et al. | |
| 6,332,934 | B2 | 12/2001 | Tanida et al. | |
| 6,458,220 | B1 | 10/2002 | Kuehmann et al. | |
| 6,464,801 | B2 * | 10/2002 | Kuehmann et al. | 148/319 |
| 6,485,582 | B1 | 11/2002 | Kuehmann et al. | |
| 6,491,767 | B1 | 12/2002 | Kuehmann | |
| 6,746,548 | B2 * | 6/2004 | Kusinski et al. | 148/320 |
| 7,160,399 | B2 | 1/2007 | Kuehmann et al. | |
| 7,235,212 | B2 | 6/2007 | Kuehmann et al. | |

FOREIGN PATENT DOCUMENTS

| | | | |
|---|---|---|---|
| EP | 0770696 | A1 | 2/1997 |
| JP | 6-65692 | | 3/1991 |
| JP | 06-65692 | | 3/1991 |
| JP | 06065692 | | 3/1994 |
| WO | 97/12073 | | 4/1997 |
| WO | 98/10112 | | 3/1998 |
| WO | 99/07910 | | 2/1999 |
| WO | 99/36584 | | 7/1999 |
| WO | 00/26428 | | 5/2000 |
| WO | 00/53821 | | 9/2000 |
| WO | 00/65120 | | 11/2000 |
| WO | 01/10591 | A1 | 2/2001 |
| WO | 01/31076 | A1 | 5/2001 |
| WO | 01/40526 | A1 | 6/2001 |
| WO | 01/79576 | A1 | 10/2001 |

OTHER PUBLICATIONS

European Search Report Application No. 10151840.5-2122 dated Apr. 20, 2010.

Campbell et al., "Systems design of high performance stainless steels I. Conceptual and computational design", Journal of Computer-Aided Materials Design 7: 145-170, 2001.

Campbell et al., "Systems design of high performance stainless steels II. Prototype characterization", Journal of Computer-Aided Materials Design 7: 171-194, 2001.

Aerospace Material Specification, AMS 6257A [SAE International, Warrendale, PA, 2001].

Philip, T.V. and T.J. McCaffrey, Ultrahigh-Strength Steels, Properties and Selection: Irons, Steels and High-Performance Alloys, Materials Park, OH, AMS International, 1: 430-448.

Aerospace Material Specification[AMS 5659K, SAE International, Warrendale, PA, 1998].

Carpenter Custom 465 [Alloy Digest, SS-716, Materials Park, OH, ASM International, May 1998].

Kimmel, W.M., Kuhn, N.S. and Berry, R.F., Cryogenic Model Materials, 39th AIAA Aerospace Sciences Meeting & Exhibit, Reno, NV 2001.

Alloy Digest, SS-716, Materials Park, OH, ASM International (1998).

Olson, G., B "Computational Design of Hierarchically Structured Materials," Science 277: 1237-1242 (1997).

Campbell, C., Systems Design of High Performace Stainless Steels, Materials Science and Engineering, Evanston, IL, Northwestern: 243 (1997).

ASTM E112 [ASTM, ASTM E112-96, West Conshohocken, PA 1996].

Montogmery, J.S. and Olsen, G.B., "M2C Carbind Precipitation in AF1410", U.S. Army Materials Technology Laboratory and Northwestern University, Speich Symposium Proceedings, 1992, A Publication of Iron and Steel Society, pp. 177-214.

ASM Handbook, vol. 4 Heat Treating, ASM, The Materials Information Society, 1991.

C.E. Campbell and G.B. Olson, Systems design of high performance stainless steels I. Conceptual and computational design; Journal of Computer Aided Materials Design, 7: 145-170, 2001.

Aerospace Material Specification, AMS 6257A, Warrendale, PA, SAE International (2001).

Philip, T.V. and T. J. McCaffrey (1990), Ultrahigh-Strength Steels, Properties and Selection: Irons, Steels and High-Performance Alloy. Materials Park, OH, ASM International, 1: 430-448.

Aerospace Material Specification, AMS 5659F, Warrendale, PA, SAE Internationa (1998).

Carpenter Custom 465™, Alloy Digest, 1998, SS-716, ASM International, Materials Park, OH.

Kimmel, W.M., N.S. Kuhn, et al., Cryogenic Model Materials, 38th AIAA Aerospace Sciences Meeting and Exhibit, Reno, NV (2001).

Olson, G.B., Computational Design of Hierarchically Structured Materials:, Science 277, pp. 1237-1242, 1997.

* cited by examiner

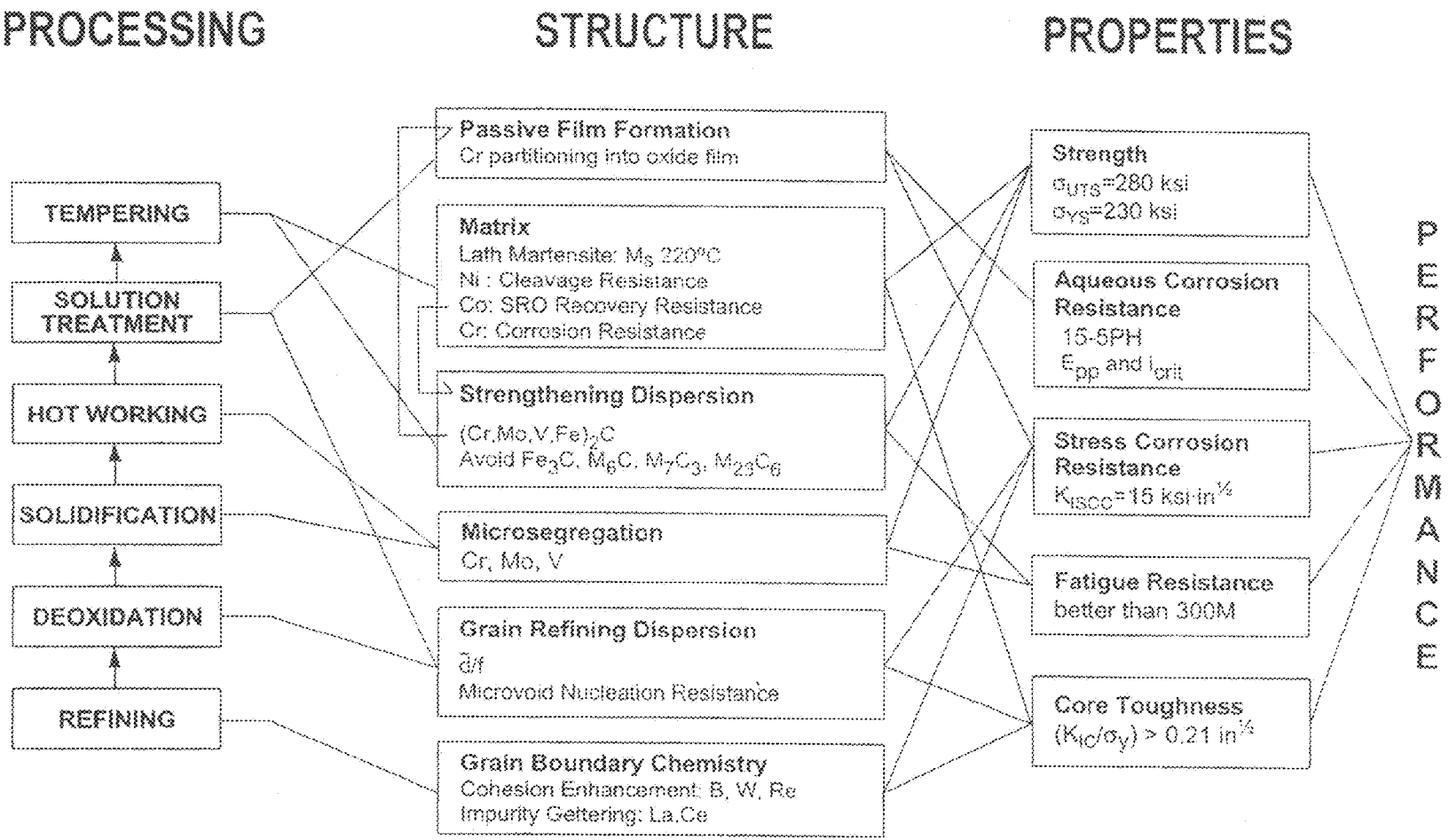
FIG. 1 FLOW-BLOCK DIAGRAM THAT CHARACTERIZES THE DESIGN CONCEPTS OF THE ALLOYS OF THE INVENTION

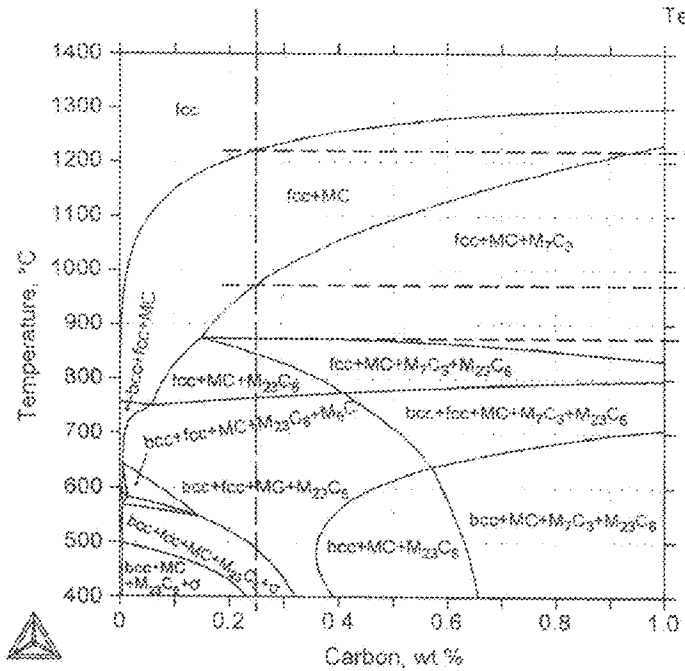
FIG. 2A AN EQUILIBRIUM PHASE DIAGRAM DEPICTING THE PHASE AND COMPOSITION OF PHASES AT VARIOUS TEMPERATURES IN EXAMPLE ALLOY 2C OF THE INVENTION.
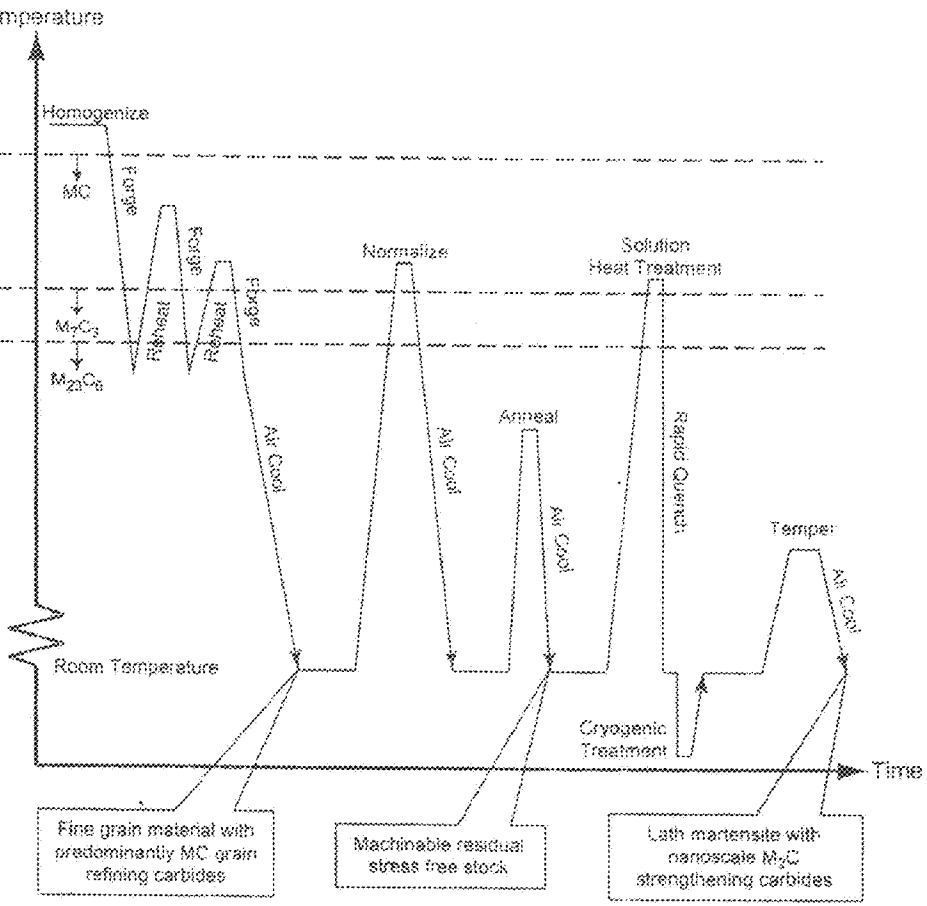
FIG. 1B A DIAGRAM OF THE TYPICAL PROCESSING PATH FOR ALLOYS OF THE INVENTION IN RELATION TO THE EQUILIBRIUM PHASES PRESENT

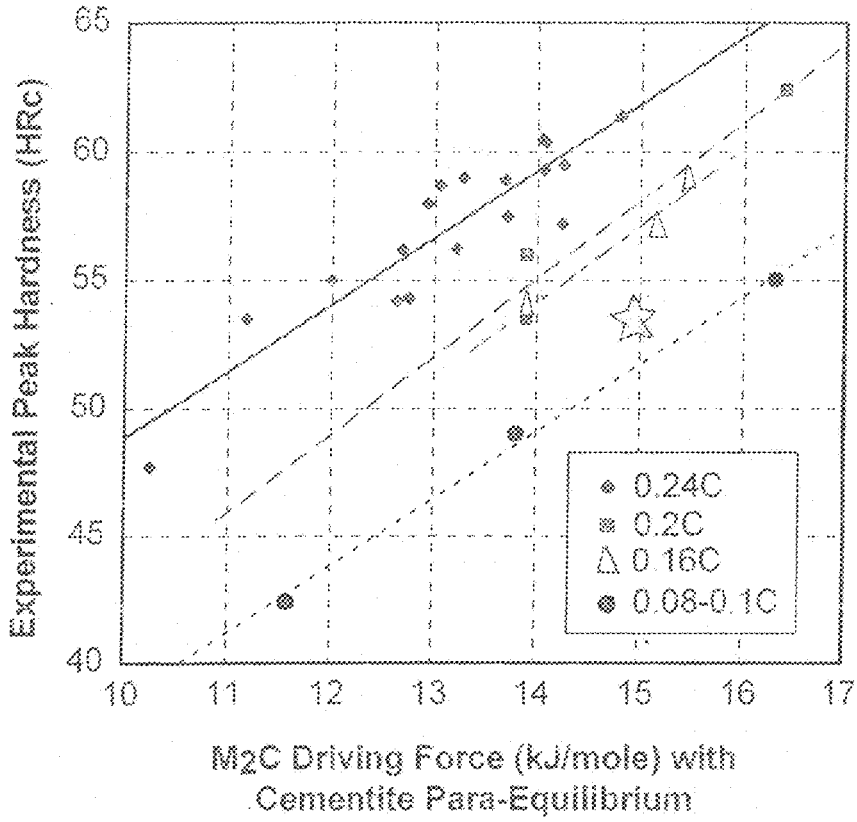
FIG. 3 CORRELATION BETWEEN PEAK HARDNESS AND $M_2C$ DRIVING FORCES FOR VARYING CARBON (C) CONTENT.

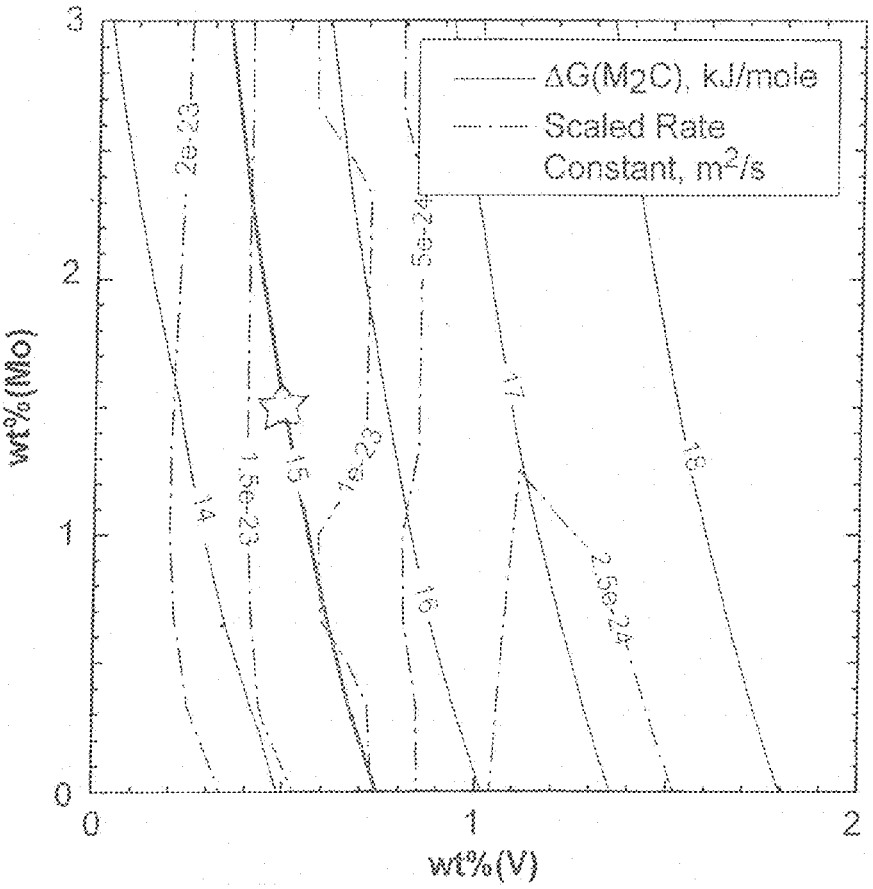
FIG. 4 CONTOURS OF $M_2C$ DRIVING FORCE (ΔG) AND SCALED RATE CONSTANT FOR VARYING MOLBDENUM (Mo) AND VANADIUM (V) CONTENTS, WHERE TEMPERATURE HAS BEEN SET TO 482°C, AND AMOUNTS OF OTHER ALLOYING ELEMENTS HAVE BEEN SET TO, BY WEIGHT, 0.14% C, 9% Cr, 13% Co, AND 4.8% Ni.

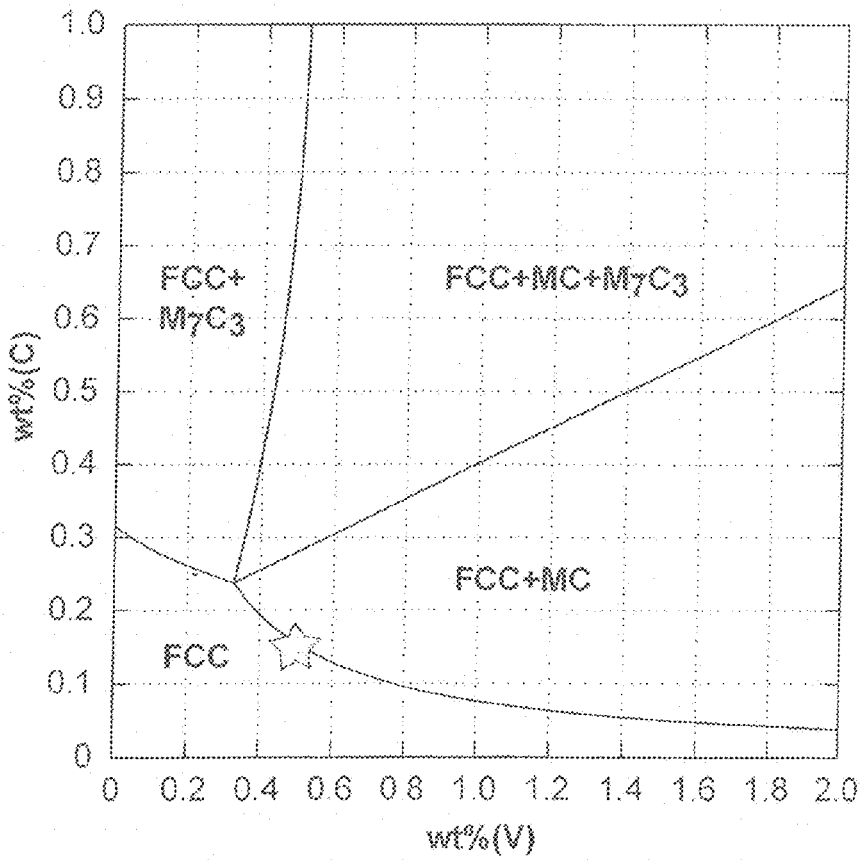
FIG. 5 PHASE DIAGRAM AT 1000°C USED TO DETERMINE FINAL VANADIUM (V) CONTENT FOR A CARBON (C) CONTENT OF 0.14% BY WEIGHT, WHERE OTHER ALLOYING ELEMENTS HAVE BEEN SET TO, BY WEIGHT, 9% Cr, 1.5% Mo, 13% Co, AND 4.8% Ni.

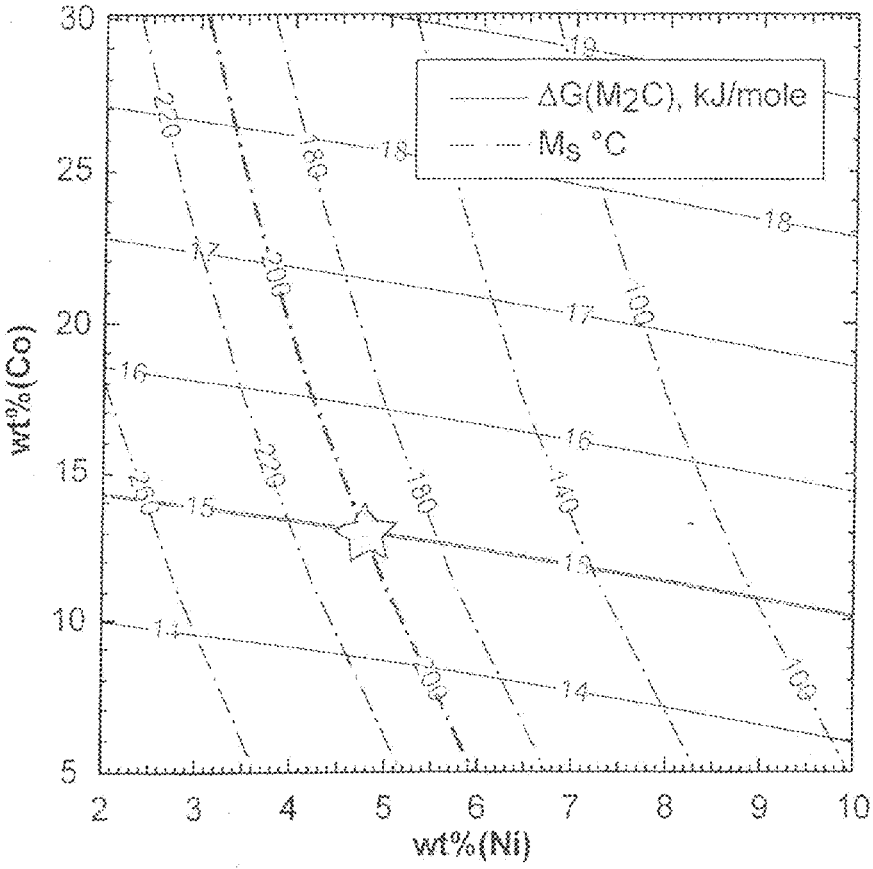
FIG. 6 CONTOURS OF $M_S$ TEMPERATURE AND $M_2C$ DRIVING FORCE (ΔG) FOR VARYING COBALT (Co) AND NICKEL (Ni) CONTENTS, WHERE TEMPERATURE HAS BEEN SET TO 482°C, AND OTHER ALLOYING ELEMENT AMOUNTS HAVE BEEN SET TO, BY WEIGHT, 0.14% C, 9% Cr, 1.5% Mo, AND 0.5% V.

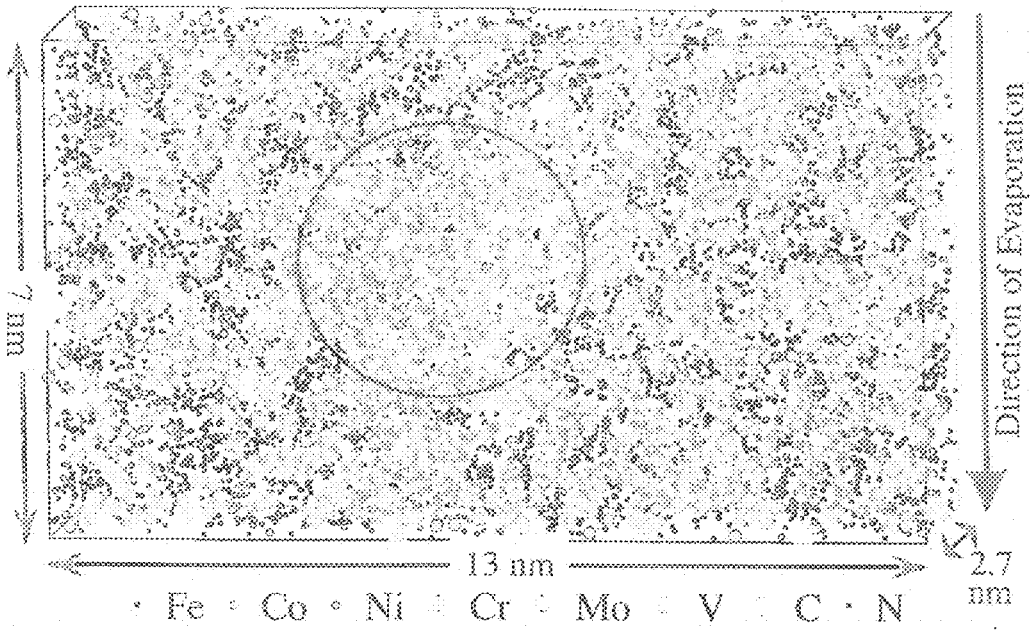
FIG. 7 3-DIMENSIONAL ATOM-PROBE IMAGE OF AN $M_2C$ CARBIDE OPTIMALLY HEAT TREATED TO 3 nm DIAMETER IN EXAMPLE ALLOY 2C

NANOCARBIDE PRECIPITATION STRENGTHENED ULTRAHIGH-STRENGTH, CORROSION RESISTANT, STRUCTURAL STEELS

CROSS REFERENCE TO RELATED APPLICATIONS

This is a continuation utility application based upon U.S. Ser. No. 10/360,204 filed Feb. 6, 2003 (now U.S. Pat. No. 7,160,399), which is a continuation-in-part utility application based upon U.S. Ser. No. 10/071,688, filed Feb. 8, 2002 now U.S. Pat. No. 7,235,212, which is based on the following provisional applications U.S. Ser. No. 60/267,627, filed Feb. 9, 2001, entitled, "Nano-Precipitation Strengthened Ultra-High Strength Corrosion Resistant Structural Steels" and U.S. Ser. No. 60/323,996 filed Sep. 21, 2001 entitled, "Nano-Precipitation Strengthened Ultra-High Strength Corrosion Resistant Structural Steels", all of which are incorporated herewith by reference in their entireties and for which priority is claimed.

BACKGROUND OF THE INVENTION

In a principal aspect, the present invention relates to cobalt, nickel, chromium stainless martensitic steel alloys having ultrahigh strength and corrosion resistance characterized by nanoscale sized carbide precipitates, in particular, $M_2C$ precipitates.

Main structural components in aerospace and other high-performance structures are almost exclusively made of ultra-high-strength steels because the weight, size and, in some cases, cost penalties associated with use of other materials is prohibitive. However, ultrahigh-strength steels with a tensile strength in the range of at least 240 ksi to 300 ksi have poor general corrosion resistance and are susceptible to hydrogen and environmental embrittlement.

Thus, to provide general corrosion resistance in aerospace and other structural steel components, cadmium plating of the components is typically employed, and when wear resistance is needed, hard chromium plating is predominantly used. These coatings have disadvantages from a cost, manufacturing, environmental and reliability standpoint. Consequently, a goal in the design or discovery of ultrahigh-strength steel alloys is elimination of the need for cadmium and chromium coatings without a mechanical deficit or diminishment of strength. One performance objective for alloys of the subject invention is replacement of non-stainless structural steels with stainless or corrosion resistant steels that have tensile strengths greater than about 240 ksi, that do not require cadmium coating and which demonstrate wear resistance without chromium plating or other protective and wear resistant coatings.

One of the most widely used ultrahigh-strength steels in use for aerospace structural applications is 300M steel. This alloy is essentially 4340 steel modified to provide a slightly higher Stage I tempering temperature, thereby allowing the bakeout of embrittling hydrogen introduced during processing. Aerospace Material Specification AMS 6257A [SAE International, Warrendale, Pa., 2001], which is incorporated herewith, covers a majority of the use of 300M steel in aerospace applications. Within this specification minimum tensile properties are 280 ksi ultimate tensile strength (UTS), 230 ksi yield strength (YS), 8% elongation and a reduction of area of 30%. The average plane strain mode I fracture toughness is 52 ksi [Philip, T. V. and T. J. McCaffrey, Ultrahigh-Strength Steels, *Properties and Selection: Irons, Steels, and High-Performance Alloys*, Materials Park, Ohio, ASM International, 1: 430-448, 1990], which is incorporated herewith. Stress corrosion cracking resistance in a 3.5% by weight aqueous sodium chloride solution is reported as 10 ksi.

The high tensile strength of 300M steel allows the design of lightweight structural components in aerospace systems such as landing gear. However, the lack of general corrosion resistance requires cadmium coating, and the low stress corrosion cracking resistance results in significant field failures due to environmental embrittlement.

Precipitation hardening stainless steels, primarily 15-5PH, [AMS 5659K, SAE International, Warrendale, Pa., 1998], which is incorporated herewith, may also be used in structural aerospace components, but typically only in lightly loaded applications where the weight penalties due to its low strength are not large. Corrosion resistance is sufficient for such an alloy so that cadmium plating can be eliminated; however minimum tensile properties of 15-5PH in the maximum strength H900 condition are only 190 ksi UTS and 170 ksi YS. This limits the application to components that are not strength limited.

Another precipitation strengthening stainless steel, Carpenter Custom 465™ steel [Alloy Digest, SS-716, Materials Park, Ohio, ASM International, 1998], which is incorporated herewith, uses intermetallic precipitation and reaches a maximum UTS of slightly below 270 ksi. At that strength level Custom 465™ steel has a low Charpy V-notch impact energy of about 5 ft-lb [Kimmel, W. M., N. S. Kuhn, et al., Cryogenic Model Materials, 39th AIAA Aerospace Sciences Meeting & Exhibit, Reno, Nev., 2001], which is incorporated herewith. For most structural applications Custom 465™ steel must be used in a condition that limits its UTS to well below 270 ksi in order to maintain adequate Charpy V-notch impact resistance.

A number of secondary hardening stainless steels have been developed that reach ultimate strength levels of up to 270 ksi. These are disclosed in U.S. Pat. Nos. Re. 26,225, 3,756,808, 3,873,378, and 5,358,577. These stainless steels use higher chromium levels to maintain corrosion resistance and therefore compromise strength. A primary feature of these alloys is the large amount of austenite, both retained and formed during secondary hardening. The austenite modifies the flow behavior of the alloys and, while they may achieve an UTS as high as 270 ksi, their yield strength is no more than 200 ksi. This large gap between yield and ultimate limits the applications for which these steels can be used. Thus there has remained the need for ultrahigh strength, noncorrosive steel alloys that have a yield strength of at least about 230 ksi and an ultimate tensile strength of at least about 280 ksi.

SUMMARY OF THE INVENTION

Briefly, the invention comprises stainless steel alloys comprising, by weight, about: 0.1 to 0.3% carbon (C), 8 to 17% cobalt (Co), less than 10% nickel (Ni), greater than 6% and less than 11% chromium (Cr), and less than 3% molybdenum (Mo) along with other elemental additives including minor amounts of Si, Cu, Mn, Nb, V, Ta, W, Ti, Zr, rare earths and B, the remainder iron (Fe) and incidental elements and impurities, processed so as to be principally in the martensitic phase with ultrahigh strength and noncorrosive physical characteristics as a result of the choice and amount of constituents and the processing protocol.

The alloys of the subject invention can achieve an ultimate tensile strength (UTS) of about 300 ksi with a yield strength (YS) of about 230 ksi and also provide corrosion resistance with greater than about 6% and less than about 11%, preferably less than about 10% by weight chromium. The alloys of the invention provide a combination of the observed mechanical properties of structural steels, that are currently cadmium coated and used in aerospace applications, and the corrosion properties of stainless steels without special coating or plating. Highly efficient nanoscale carbide ($M_2C$) strengthening of the described alloys provides ultrahigh strengths with lower carbon and alloy content while improving corrosion resistance due to the ability of the nanoscale carbides to oxidize and supply chromium as a passivating oxide film. This combination of ultrahigh strength and corrosion resistance properties in a single material eliminates the need for cadmium coating without a weight penalty relative to current structural steels. Additionally, alloys of the subject invention reduce environmental embrittlement driven field failures because they no longer rely on an unreliable coating for protection from the environment.

Thus, it is an object of the invention to provide a new class of ultrahigh-strength, corrosion resistant, structural steel alloys.

A further object of the invention is to provide ultrahigh-strength, corrosion resistant, structural steel alloys that do not require plating or coating to resist corrosion.

Another object of the invention is to provide ultrahigh-strength, corrosion resistant, structural steel alloys having cobalt, nickel and chromium alloying elements in combination with other elements whereby the alloys are corrosion resistant.

A further object of the invention is to provide ultrahigh-strength, corrosion resistant, structural steel alloys having an ultimate tensile strength (UTS) greater than about 240 ksi and preferably greater than about 280 ksi, and a yield strength (YS) greater than about 200 ksi and preferably greater than about 230 ksi.

Another object of the invention is to provide ultrahigh-strength, corrosion resistant, structural steel alloys characterized by a lath martensitic microstructure and by $M_2C$ nanoscale sized precipitates in the grain structure and wherein other $M_XC$ precipitates where x>2 have generally been solubilized.

Yet another object of the invention is to provide ultrahigh-strength, corrosion resistant, structural steel alloys which may be easily worked to form component parts and articles while maintaining its ultrahigh strength and noncorrosive characteristics.

A further object of the invention is to provide processing protocols for the disclosed stainless steel alloy compositions that enable creation of an alloy microstructure having highly desirable strength and noncorrosive characteristics.

These and other objects, advantages and features will be set forth in the detailed description which follows.

BRIEF DESCRIPTION OF THE DRAWING

The file of this patent contains at least one drawing executed in color. Copies of this patent with color drawing(s) will be provided by the Patent and Trademark Office upon request and payment of the necessary fee.

In the detailed description that follows, reference will be made to the drawing comprised of the following figures:

FIG. 1 is a flow block logic diagram that characterizes the design concepts of the alloys of the invention;

FIG. 2A is an equilibrium phase diagram depicting the phases and composition of carbides at various temperatures in an example of an alloy of the invention;

FIG. 2B is a diagram of the typical processing path for alloys of the invention in relation to the equilibrium phases present;

FIG. 3 is a graph correlating peak hardness and $M_2C$ driving forces for varying carbon (C) content, with values in weight percent;

FIG. 4 is a graph showing contours of $M_2C$ driving force ($\Delta G$) and scaled rate constant for varying molybdenum (Mo) and vanadium (V) contents, where temperature has been set to 482C, and amounts of other alloying elements have been set to 0.14% by weight carbon (C), 9% by weight chromium (Cr), 13% by weight cobalt (Co), and 4.8% by weight nickel (Ni);

FIG. 5 is a phase diagram at 1000 C used to determine final vanadium (V) content for a carbon (C) content of 0.14% by weight, where other alloying element amounts have been set to 9% by weight chromium (Cr), 1.5% by weight molybdenum (Mo), 13% by weight cobalt (Co), and 4.8% by weight nickel (Ni);

FIG. 6 is a graph showing contours of $M_S$ temperature and $M_2C$ driving force ($\Delta G$) for varying cobalt (Co) and nickel (Ni) contents, where temperature has been set to 482C, and other alloying element amounts have been set to 0.14% by weight carbon (C), 9% by weight chromium (Cr), 1.5% by weight molybdenum (Mo), and 0.5% by weight vanadium (V) in an embodiment of the invention; and;

FIG. 7 is a 3-dimensional atom-probe image of an $M_2C$ carbide in an optimally heat treated preferred embodiment and example of the invention.

DETAILED DESCRIPTION OF THE INVENTION

The steel alloys of the invention exhibit various physical characteristics and processing capabilities. These characteristics and capabilities were established as general criteria, and subsequently the combination of elements and the processing steps appropriate to create such steel alloys to meet these criteria were identified. FIG. 1 is a system flow-block diagram which illustrates the processing/structure/properties/performance relationships for alloys of the invention. The desired performance for the application (e.g. aerospace structures, landing gear, sports equipment, tools, etc.) determines a set of alloy properties required. Alloys of the invention exhibit the structural characteristics that can achieve the desired combination of properties and can be assessed through the sequential processing steps shown on the left of FIG. 1. Following are the criteria for the physical properties and the processing capabilities or characteristics for the alloys. This is followed by a description of the analytical and experimental techniques relating to the discovery and examples of the alloys that define, in general, the range and extent of the elements, physical characteristics and processing features of the present invention.

Physical Characteristics

The physical characteristics or properties of the most preferred embodiments of the invention are generally as follows:

Corrosion resistance equivalent to 15-5PH (H900 condition) as measured by linear polarization.

Strength equivalent to or better than 300M alloy, i.e.:

Ultimate Tensile Strength (UTS)=280 ksi.

Yield Strength (YS)=230 ksi.

Elongation (EL)=8%.

Reduction of Area (RA)=30%.

Stress Corrosion Cracking Resistance ($K_{Iscc}$)>15 ksi $\sqrt{in}$.

$$\frac{K+c}{ys} \geq 0.21$$

Surface hardenable to =67 Rockwell C (HRC) for wear and fatigue resistance.

Optimum microstructural features for maximum fatigue/corrosion fatigue resistance.

Processability Characteristics

A principal goal of the subject invention is to provide alloys with the objective physical properties recited above and with processability that renders the alloys useful and practical. With a number of possible processing paths associated with the scale of manufacture and the resulting cleanliness and quality for a given application, compatibility of the alloys of the subject invention with a wide range of processes is desirable and is thus a feature of the invention.

A primary objective for and characteristic of the alloys is compatibility with melting practices such as Vacuum Induction Melting (VIM), Vacuum Arc Remelting (VAR), and Electro-Slag Remelting (ESR) and other variants such as Vacuum Electro-Slag Remelting (VSR). Alloys of the subject invention can also be produced by other processes such as air melting and powder metallurgy. Of importance is the behavior of the alloys to exhibit limited solidification microsegregation under the solidification conditions of the above processes. By selection of appropriate elemental content in the alloys of the subject invention, the variation of composition that results from solidification during processing across a secondary dendrite can be minimized. Allowable variation results in an alloy that can be homogenized at commercially feasible temperatures, usually at metal temperatures in excess of 1100 C and up to the incipient melting of the alloy, and for reasonable processing times, typically less than seventy-two hours and preferably less than thirty-six hours.

Alloys of the subject invention also possess reasonable hot ductility such that hot working after homogenization can be accomplished within temperature and reduction constraints typical of current industrial practice. Typical hot working practice for alloys of the subject invention should enable cross-sectional reduction ratios in excess of three to one and preferably in excess of five to one. In addition, initial hot working of the ingot should be possible below 1100 C, and finish hot working to the desired product size should be possible at temperatures below 950 C.

Objectives regarding solution heat treatment include the goal to fully dissolve all primary alloy carbides (i.e. $M_XC$ where X>2) while maintaining a fine scale grain refining dispersion (i.e. MC) and a small grain size, generally equal to or smaller than ASTM grain size number 5 in accordance with ASTM E112 [ASTM, ASTM E112-96, West Conshohocken, Pa., 1996] which is incorporated herewith. Thus with the alloys of the invention, during solution heat treatment into the austenite phase field, coarse scale alloy carbides that formed during prior processing are dissolved, and the resulting carbon in solution is then available for precipitation strengthening during tempering. However, during the same process the austenite grains can coarsen, thereby reducing strength, toughness and ductility. With alloys of the invention, such grain coarsening is slowed by MC precipitates that pin the grain boundaries and, as solution heat treatment temperature increases, the amount of this grain refining dispersion needed to avoid or reduce grain coarsening increases. Alloys of the subject invention generally thoroughly dissolve all coarse scale carbides, i.e. $M_xC$ where x>2, while maintaining an efficient grain refining dispersion at reasonable solution heat treatment temperatures in the range of 850° C. to 1100° C., preferably 950° C. to 1050° C.

After the solution heat treatment, components manufactured from the alloys of the subject invention are typically rapidly cooled or quenched below temperatures at which martensite forms. The preferred result of this process is a microstructure that consists of essentially all martensite with virtually no retained austenite, other transformation products such as bainite or ferrite, or other carbide products that remain or are formed during the process. The thickness of the component being cooled and the cooling media such as oil, water, or air determine the cooling rate of this type of process. As the cooling rate increases, the risk of forming other non-martensitic products is reduced, but the distortion in the component potentially increases, and the section thickness of a part that can be processed thus decreases. Alloys of the subject invention are generally, fully martensitic after cooling or quenching at moderate rates in section sizes less than three inches and preferably less than six inches when cooled to cryogenic temperatures, or preferably to room temperature.

After cooling or quenching, components manufactured using alloys of the subject invention may be tempered in a temperature range and for a period of time in which the carbon in the alloy will form coherent nanoscale $M_2C$ carbides while avoiding the formation of other carbide products, i.e. $M_xC$ where x>2. During this aging or secondary hardening process the component is heated to the process temperature at a rate determined by the power of the furnace and the size of the component section and held for a reasonable time, then cooled or quenched to room temperature.

If the prior solution treatment has been ineffective in avoiding retained austenite, the tempering process may be divided into multiple steps where each tempering step is followed by a cool or quench to room temperature and preferably a subsequent cool to cryogenic temperatures to form martensite. The temperature of the temper process would typically be between 200° C. to 600° C., preferably 450° C. to 540° C. and be less than twenty-four hours in duration, preferably between two to ten hours. The outcome of the desired process is a martensitic matrix (generally free of austenite) strengthened by a nanoscale $M_2C$ carbide dispersion, devoid of transient cementite that forms during the early stages of the process, and without other alloy carbides that may precipitate if the process time becomes too long.

A significant feature of alloys of the invention is related to the high tempering temperatures used to achieve its secondary hardening response. Although a specific goal is to avoid cadmium plating for corrosion resistance, many components made from an alloy of the invention may require an electroplating process such as nickel or chromium during manufacture or overhaul. Electroplating processes introduce hydrogen into the microstructure that can lead to embrittlement and must be baked out by exposing the part to elevated temperatures after plating. Alloys of the invention can be baked at temperatures nearly as high as their original tempering temperature without reducing the strength of the alloy. Since tempering temperatures are significantly higher in alloys of the invention compared to commonly used 4340 and 300M alloys, the bake-out process can be accomplished more quickly and reliably.

Certain surface modification techniques for wear resistance, corrosion resistance, and decoration, such as physical vapor deposition (PVD), or surface hardening techniques such as gas or plasma nitriding, are optimally performed at temperatures on the order of 500° C. and for periods on the order of hours. Another feature of alloys of the subject invention is that the heat-treating process is compatible with the temperatures and schedules typical of these surface coating or hardening processes.

Components made of alloys of the subject invention are typically manufactured or machined before solution heat treatment and aging. The manufacturing and machining operations require a material that is soft and exhibits favorable chip formation as material is removed. Therefore alloys of the subject invention are preferably annealed after the hot working process before they are supplied to a manufacturer. The goal of the annealing process is to reduce the hardness of an alloy of the subject invention without promoting excessive austenite. Typically annealing would be accomplished by heating the alloy in the range of 600° C. to 850° C., preferably in the range 700° C. to 750° C. for a period less than twenty-four hours, preferably between two and eight hours and cooling slowly to room temperature. In some cases a multiple-step annealing process may provide more optimal results. In such a process an alloy of the invention may be annealed at a series of temperatures for various times that may or may not be separated by an intermediate cooling step or steps.

After machining, solution heat treatment and aging, a component made of an alloy of the subject invention may require a grinding step to maintain the desired final dimensions of the part. Grinding of the surface removes material from the part by abrasive action against a high-speed ceramic wheel. Damage to the component by overheating of the surface of the part and damage to the grinding wheel by adhesion of material needs to be avoided. These complications can be avoided primarily by lowering the retained austenite content in the alloy. For this and the other reasons stated above, alloys of the subject invention exhibit very little retained austenite after solution heat treatment.

Many components manufactured from alloys of the subject invention may require joining by various welding process such as gas-arc welding, submerged-arc welding, friction-stir welding, electron-beam welding and others. These processes require the material that is solidified in the fusion zone or in the heat-affected zone of the weld to be ductile after processing. Pre-heat and post-heat may be used to control the thermal history experienced by the alloy within the weld and in the heat-affected zone to promote weld ductility. A primary driver for ductile welds is lower carbon content in the material, however this also limits strength. Alloys of the subject invention achieve their strength using very efficient nanoscale $M_2C$ carbides and therefore can achieve a given level of strength with lower carbon content than steels such as 300M steel, consequently promoting weldability.

Microstructure and Composition Characteristics

The alloy designs achieve required corrosion resistance with a minimum Cr content because high Cr content limits other desired properties in several ways. For example, one result of higher Cr is the lowering of the martensite $M_S$ temperature which, in turn, limits the content of other desired alloying elements such as Ni. High Cr levels also promote excessive solidification microsegregation that is difficult to eliminate with high-temperature homogenization treatments. High Cr also limits the high-temperature solubility of C required for carbide precipitation strengthening, causing use of high solution heat treatment temperatures for which grain-size control becomes difficult. Thus, a feature of the alloys of the invention is utilization of Cr in the range of greater than about 6% and less than about 11% (preferably less than about 10%) by weight in combination with other elements as described to achieve corrosion resistance with structural strength.

Another feature of the alloys is to achieve the required carbide strengthening with a minimum carbon content. Like Cr, C strongly lowers $M_S$ temperatures and raises solution temperatures. High C content also limits weldability, and can cause corrosion problems associated with Cr carbide precipitation at grain boundaries. High C also limits the extent of softening that can be achieved by annealing to enhance machinability.

Both of the primary features just discussed are enhanced by the use of Co. The thermodynamic interaction of Co and Cr enhances the partitioning of Cr to the oxide film formed during corrosion passivation, thus providing corrosion protection equivalent to a higher Cr steel. Co also catalyzes carbide precipitation during tempering through enhancement of the precipitation thermodynamic driving force, and by retarding dislocation recovery to promote heterogeneous nucleation of carbides on dislocations. Thus, C in the range of about 0.1% to 0.3% by weight combined with Co in the range of about 8% to 17% by weight along with Cr as described, and the other minor constituent elements, provides alloys with corrosion resistance and ultrahigh strength.

The desired combination of corrosion resistance and ultrahigh strength is also promoted by refinement of the carbide strengthening dispersion down to the nanostructural level, i.e., less than about ten nanometers in diameter and preferably less than about five nanometers. Compared to other strengthening precipitates such as the intermetallic phases employed in maraging steels, the relatively high shear modulus of the $M_2C$ alloy carbide decreases the optimal particle size for strengthening down to a diameter of only about three nanometers. Refining the carbide precipitate size to this level provides a highly efficient strengthening dispersion. This is achieved by obtaining a sufficiently high thermodynamic driving force through alloying. This refinement provides the additional benefit of bringing the carbides to the same length scale as the passive oxide film so that the Cr in the carbides can participate in film formation. Thus the carbide formation does not significantly reduce corrosion resistance. A further benefit of the nanoscale carbide dispersion is effective hydrogen trapping at the carbide interfaces to enhance stress corrosion cracking resistance. The efficient nanoscale carbide strengthening also makes the system well suited for surface hardening by nitriding during tempering to produce $M_2(C,N)$ carbonitrides of the same size scale for additional efficient strengthening without significant loss of corrosion resistance. Such nitriding can achieve surface hardness as high as 1100 Vickers Hardness (VHN) corresponding to 70 HRC.

Toughness is further enhanced through grain refinement by optimal dispersions of grain refining MC carbide dispersions that maintain grain pinning during normalization and solution treatments and resist microvoid nucleation during ductile fracture. Melt de oxidation practice is controlled to favor formation of Ti-rich MC dispersions for this purpose, as well as to minimize the number density of oxide and oxysulfide inclusion particles that form primary voids during fracture. Under optimal conditions, the amount of MC, determined by mass balance from the available Ti content, accounts for less than 10% of the alloy C content. Increasing Ni content within the constraints of the other requirements enhances resistance to brittle fracture. Refinement of $M_2C$ particle size through precipitation driving force control allows ultrahigh strength to be maintained at the completion of $M_2C$ precipitation in order to fully dissolve $Fe_3C$ cementite carbides that precipitate prior to $M_2C$ and limit fracture toughness through microvoid nucleation. The cementite dissolution is considered effectively complete when $M_2C$ accounts for 85% of the alloy C content, as assessed by the measured $M_2C$ phase fraction using techniques described by Montgomery [Montgomery, J. S. and G. B. Olson, $M_2C$ Carbide Precipitation in AF1410, Gilbert R. Speich Symposium: Fundamentals of Aging and Tempering in Bainitic and Martensitic Steel Products, ISS-AIME, Warrendale, Pa., 177-214, 1992], which is incorporated herewith. Precipitation of other phases that can limit toughness such as other carbides (e.g. $M_{23}C_6$, $M_6C$ and $M_7C_3$) and topologically close packed (TCP) intermetallic phases (e.g. y and ÿ phases) is avoided by constraining the thermodynamic driving force for their formation.

In addition to efficient hydrogen trapping by the nanoscale $M_2C$ carbides to slow hydrogen transport, resistance to hydrogen stress-corrosion is further enhanced by controlling segregation of impurities and alloying elements to prior-austenite grain boundaries to resist hydrogen-assisted intergranular fracture. This is promoted by controlling the content of undesirable impurities such as P and S to low levels and gettering their residual amounts in the alloy into stable compounds such as $La_2O_2S$ or $Ce_2O_2S$. Boundary cohesion is further enhanced by deliberate segregation of cohesion enhancing elements such as B, Mo and W during heat treatment. These factors promoting stress corrosion cracking resistance will also enhance resistance to corrosion fatigue.

All of these conditions are achieved by the class of alloys discovered while maintaining solution heat treatment temperatures that are not excessively high. Martensite $M_S$ temperatures, measured by quenching dilatometry and 1% transformation fraction, are also maintained sufficiently high to establish a lath martensite microstructure and minimize the content of retained austenite which can otherwise limit yield strength.

Preferred Processing Techniques

The alloys can be produced via various process paths such as for example casting, powder metallurgy or ingot metallurgy. The alloy constituents can be melted using any conventional melt process such as air melting but more preferably by vacuum induction melting (VIM). The alloy can thereafter be homogenized and hot worked, but a secondary melting process such as electro slag remelting (ESR) or vacuum arc remelting (VAR) is preferred in order to achieve improved fracture toughness and fatigue properties. In order to achieve even higher fracture toughness and fatigue properties additional remelting operations can be utilized prior to homogenization and hot working. In any event, the alloy is initially formed by combination of the constituents in a melt process.

The alloy may then be homogenized prior to hot working or it may be heated and directly hot worked. If homogenization is used, it may be carried out by heating the alloy to a metal temperature in the range of about 1100° C. or 1110° C. or 1120° C. to 1330° C. or 1340° C. or 1350° C. or, possibly as much as 1400° C. for a period of time of at least four hours to dissolve soluble elements and carbides and to also homogenize the structure. One of the design criteria for the alloy is low microsegregation, and therefore the time required for homogenization of the alloy is typically shorter than other stainless steel alloys. A suitable time is six hours or more in the homogenization metal temperature range. Normally, the soak time at the homogenization temperature does not have to extend for more than seventy-two hours. Twelve to eighteen hours in the homogenization temperature range has been found to be quite suitable. A typical homogenization metal temperature is about 1240° C.

After homogenization the alloy is typically hot worked. The alloy can be hot worked by, but not limited to, hot rolling, hot forging or hot extrusion or any combinations thereof. It is common to initiate hot working immediately after the homogenization treatment in order to take advantage of the heat already in the alloy. It is important that the finish hot working metal temperature is substantially below the starting hot working metal temperature in order to assure grain refinement of the structure through precipitation of MC carbides. After the first hot working step, the alloy is typically reheated for continued hot working to the final desired size and shape. The reheating metal temperature range is about 950° C. or 960° C. or 970° C. to 1230° C. or 1240° C. or 1250° C. or possibly as much as 1300° C. with the preferred range being about 1000° C. or 1010° C. to 1150° C. or 1160° C. The reheating metal temperature is near or above the solvus temperature for MC carbides, and the objective is to dissolve or partially dissolve soluble constituents that remain from casting or may have precipitated during the preceding hot working. This reheating step minimizes or avoids primary and secondary phase particles and improves fatigue crack growth resistance and fracture toughness.

As the alloy is continuously hot worked and reheated the cross-sectional size decreases and, as a result, the metal cools faster. Eventually it is no longer possible to use the high reheating temperatures, and a lower reheating temperature must be used. For smaller cross-sections the reheating metal temperature range is about 840° C. or 850° C. or 860° C. to 1080° C. or 1090° C. or 1100° C. or possibly as much as 1200° C. with the preferred range being about 950° C. or 960° C. to 1000° C. or 1010° C. The lower reheating metal temperature for smaller cross-sections is below the solvus temperature for other (non-MC) carbides, and the objective is to minimize or prevent their coarsening during reheating so that they can quickly be dissolved during the subsequent normalizing or solution heat treatment.

Final mill product forms such as, for example, bar stock and forging stock are typically normalized and/or annealed prior to shipment to customers. During normalizing the alloy is heated to a metal temperature above the solvus temperature for all carbides except MC carbides, and the objective is to dissolve soluble constituents that may have precipitated during the previous hot working and to normalize the grain size. The normalizing metal temperature range is about 880° C. or 890° C. or 900° C. to 1080° C. or 1090° C. or 1100° C. with the preferred range being about 1020° C. to 1030° C. or 1040° C. A suitable time is one hour or more and typically the soak time at the normalizing temperature does not have to extend for more than three hours. The alloy is thereafter cooled to room temperature.

After normalizing the alloy is typically annealed to a suitable hardness or strength level for subsequent customer processing such as, for example, machining. During annealing the alloy is heated to a metal temperature range of about 600° C. or 610° C. to 840° C. or 850° C., preferably between 700° C. to 750° C. for a period of at least one hour to coarsen all carbides except the MC carbide. A suitable time is two hours or more and typically the soak time at the annealing temperature does not have to extend for more than twenty-four hours.

Typically after the alloy has been delivered to a customer and processed to, or near, its final form and shape it is subjected to solution heat treatment preferably in the metal temperature range of about 850° C. or 860° C. to 1090° C. or 1100° C., more preferably about 950° C. to 1040° C. or 1050° C. for a period of three hours or less. A typical time for solution heat treatment is one hour. The solution heat treatment metal temperature is above the solvus temperature for all carbides except MC carbides, and the objective is to dissolve soluble constituents that may have precipitated during the preceding processing. This inhibits grain growth while enhancing strength, fracture toughness and fatigue resistance.

After solution heat treatment it is important to cool the alloy fast enough to about room temperature or below in order to transform the microstructure to a predominantly lath martensitic structure and to prevent or minimize boundary precipitation of primary carbides. Suitable cooling rates can be achieved with the use of water, oil, or various quench gases depending on section thickness.

After quenching to room temperature the alloy may be subjected to a cryogenic treatment or it may be heated directly to the tempering temperature. The cryogenic treatment promotes a more complete transformation of the microstructure to a lath martensitic structure. If a cryogenic treatment is used, it is carried out preferably below about −70° C. A more preferred cryogenic treatment would be below about −195° C. A typical cryogenic treatment is in the metal temperature range of about −60° C. or −70° C. to −85° C. or −95° C. Another typical cryogenic treatment is in the metal temperature range of about −180° C. or −190° C. to −220° C. or −230° C. Normally, the soak time at the cryogenic temperature does not have to extend for more than ten hours. A typical time for cryogenic treatment is one hour.

After the cryogenic treatment, or if the cryogenic treatment is omitted, immediately following quenching, the alloy is tempered at intermediate metal temperatures. The tempering treatment is preferably in the metal temperature range of about 200° C. or 210° C. or 220° C. to 580° C. or 590° C. or 600° C., more preferably about 450° C. to 530° C. or 540° C. Normally, the soak time at the tempering temperature does not have to extend for more than twenty-four hours. Two to ten hours in the tempering temperature range has been found to be quite suitable. During the tempering treatment, precipitation of nanoscale $M_2C$-strengthening particles increases the thermal stability of the alloy, and various combinations of strength and fracture toughness can be achieved by using different combinations of temperature and time.

For alloys of the invention with lower MS temperatures, it is possible to further enhance strength and fracture toughness through multi-step thermal treatments by minimizing retained austenite. Multi-step treatments consist of additional cycles of cryogenic treatments followed by thermal treatments as outlined in the text above. One additional cycle might be beneficial but multiple cycles are typically more beneficial.

An example of the relationship between the processing path and the phase stability in a particular alloy of the invention is depicted in FIGS. 2A and 2B.

FIG. 2A depicts the equilibrium phases of alloy 2C of the invention wherein the carbon content is 0.23% by weight as shown in TABLE 1.

FIG. 2B then discloses the processing sequence employed with respect to the described alloy 2C. After forming the melt via a melt processing step, the alloy is homogenized at a metal temperature exceeding the single phase (fcc) equilibrium temperature of about 1220° C. All carbides are solubilized at this temperature. Forging to define a desired billet, rod or other shape results in cooling into a range where various complex carbides may form. The forging step may be repeated by reheating at least to the metal temperature range (980° C. to 1220° C.) where only MC carbides are at equilibrium.

Subsequent cooling (air cool) will generally result in retention of primarily MC carbides, other primary alloy carbides such as $M_7C_3$ and $M_{23}C_6$ and the formation of generally a martensitic matrix. Normalization in the same metal temperature range followed by cooling dissolves the $M_7C_3$ and $M_{23}C_6$ primary carbides while preserving the MC carbides. Annealing in the metal temperature range 600° C. or 610° C. to 840° C. or 850° C. and cooling reduces the hardness level to a reasonable value for machining. The annealing process softens the martensite by precipitating carbon into alloy carbides that are too large to significantly strengthen the alloy yet are small enough to be readily dissolved during later solution treatment. This process is followed by delivery of the alloy product to a customer for final manufacture of a component part and appropriate heat treating and finishing.

Typically the customer will form the alloy into a desired shape. This will be followed by solution heat treatment in the MC carbide temperature range and then subsequent rapid quenching to maintain or form the desired martensitic structure. Tempering and cooling as previously described may then be employed to obtain strength and fracture toughness as desired.

EXPERIMENTAL RESULTS AND EXAMPLES

A series of prototype alloys were prepared. The melt practice for the refining process was selected to be a double vacuum melt with La and Ce impurity gettering additions. Substitutional grain boundary cohesion enhancers such as W and Re were not considered in the making of the first prototype, but an addition of twenty parts per million B was included for this purpose. For the deoxidation process, Ti was added as a deoxidation agent, promoting TiC particles to pin the grain boundaries and reduce grain growth during solution treatment prior to tempering.

The major alloying elements in the first prototype are C, Mo, and V ($M_2C$ carbide formers), Cr ($M_2C$ carbide former and oxide passive film former), and Co and Ni (for various required matrix properties). The exact alloy composition and material processing parameters were determined by an overall design synthesis considering the linkages and a suite of computational models described elsewhere [Olson, G. B, "Computational Design of Hierarchically Structured Materials.", Science 277, 1237-1242, 1997], which is incorporated herewith. The following is a summary of the initial prototype procedure. Selected parameters are indicated in FIGS. 3-6 by a star (★).

The amount of Cr was determined by the corrosion resistance requirement and a passivation thermodynamic model developed by Campbell [Campbell, C, Systems Design of High Performance Stainless Steels, Materials Science and Engineering, Evanston, Ill., Northwestern 243, 1997], which is incorporated herewith. The amount of C was determined by the strength requirement and an $M_2C$ precipitation/strengthening model according to the correlation illustrated in FIG. 3. Based on the goal of achieving 53 HRC hardness, a C content of 0.14% by weight was selected. The tempering temperature and the amounts of $M_2C$ carbide formers Mo and V were determined to meet the strength requirement with adequate $M_2C$ precipitation kinetics, maintain a 1000 C solution treatment temperature, and avoid microsegregation. FIGS. 4 and 5 illustrate how the final V and Mo contents were determined. Final contents by weight of 1.5% Mo and 0.5% V were selected. The level of solidification microsegregation is assessed by solidification simulation for the solidification cooling rate and associated dendrite arm spacing of anticipated ingot processing. Amounts of Co and Ni were determined to (1) maintain a martensite start temperature of at least 200° C., using a model calibrated to Ms temperatures measured by quenching dilatometry and 1% transformation fraction, so a lath martensite matrix structure can be achieved after quenching, (2) maintain a high $M_2C$ carbide initial driving force for efficient strengthening, (3) improve the bcc cleavage resistance by maximizing the Ni content, and (4) maintain the Co content above 8% by weight to achieve sufficient dislocation recovery resistance to enhance $M_2C$ nucleation and increase Cr partitioning to the oxide film by increasing the matrix Cr activity. FIG. 6 shows that, with other alloy element amounts and the tempering temperature set at their final levels, optimization of the above four factors results in the selection of Co and Ni amounts of about 13% and 4.8% by weight, respectively. The material composition and tempering temperature were fine-tuned by inspecting the driving force ratios between $M_2C$ and other carbides and intermetallic phases with reference to past studies of other precipitation hardened Ni—Co steels.

The composition of the first design prototype designated 1 is given in TABLE 1 along with later design iterations. The initial design included the following processing parameters:

a double vacuum melt with impurity gettering and Ti deoxidation;

a minimum solution treatment temperature of 1005° C., where this temperature is limited by vanadium carbide (VC) formation according to thermodynamic equilibrium; and a tempering temperature of 482° C. with an estimated tempering time of three hours to achieve optimum strength and toughness.

Evaluation of the first prototype (entry 1 in TABLE 1) gave promising results for all properties evaluated. The most significant deficiencies were a lower than desired $M_S$ temperature by 25° C. to 50° C. and a strength level 15% below objectives. A second series of designs denoted 2A, 2B and 2C in TABLE 1 were then evaluated. All three second-iteration prototypes gave satisfactory transformation temperatures, and the best mechanical properties of the second iteration were exhibited by alloy 2C. Based on the latter base composition, a third-iteration series of alloys designated 3A, 3B and 3C in TABLE 1 explored minor variations in grain-refining MC carbides, comparing TiC, (Ti,V)C, and NbC. Principal parameters were MC phase fraction and coarsening resistance at solution temperatures, subject to the constraint of full MC solubility at homogenization temperatures. Selecting (Ti,V)C as the optimal grain refining approach, a fourth-iteration design series designated 4A through 4G in TABLE 1 examined (a) refinement of martensitic transformation kinetics to minimize retained austenite content, (b) increased stability of competing $M_2C$ carbides to promote full dissolution of cementite during $M_2C$ precipitation strengthening in order to enhance fracture toughness and (c) utilized lower temperature iron (Fe) based $M_2C$ precipitation strengthening to completely avoid the precipitation of cementite and enhance cleavage resistance. Modification of carbide thermodynamics and kinetics in the latter two series included additions of W and Si.

A fifth series of alloys, designated 5B through 5F in TABLE 1, examined the limits of Ni that can be added to the alloy to improve fracture toughness by lowering the ductile to brittle transition temperature. While the alloy $M_S$ for these compositions falls below room temperature as the NI content reaches to about 10 percent by weight, it was found that tempering the alloy in multiple steps with cryogenic cooling between each step was able to convert the majority of the retained austenite to martensite. This allows good strength properties to be achieved in combination with high Ni content to control ductile fracture behavior even in alloys that are fully austenitic after quenching. Although multiple tempering has been commonly used to minimize retained austenite in steels, it was unexpected that the technique could be used effectively in alloys with such high Ni contents and high austenite contents.

The sixth series of alloys, designated 6A through 6M in TABLE 1, was determined to incorporate the features represented in the first five series and are considered preferred embodiments of the invention. Thus, appropriate processing of the described alloys provides an essentially martensitic phase.

Following is a summary of the described experiments and alloys:

TABLE 1

| Alloy | C | Co | Ni | Cr | Mo | W | Si | V | Ti | Nb |
|---|---|---|---|---|---|---|---|---|---|---|
| 1 | 0.15 | 13.0 | 4.8 | 9.0 | 1.5 | — | — | 0.50 | 0.02 | — |
| 2A | 0.18 | 12.5 | 2.8 | 9.1 | 1.3 | — | — | 0.29 | 0.03 | — |
| 2B | 0.11 | 16.7 | 3.7 | 9.2 | 2.0 | — | — | 0.50 | 0.03 | — |
| 2C | 0.23 | 12.5 | 2.8 | 9.0 | 1.3 | — | — | 0.30 | 0.03 | — |
| 3A | 0.24 | 12.4 | 2.8 | 9.0 | 1.3 | — | — | 0.29 | 0.02 | — |
| 3B | 0.24 | 12.4 | 2.8 | 9.1 | 1.3 | — | — | 0.37 | 0.03 | |
| 3C | 0.24 | 12.4 | 2.8 | 9.0 | 1.3 | — | — | 0.34 | — | 0.03 |
| 4A | 0.24 | 12.2 | 2.0 | 9.1 | 1.3 | — | — | 0.29 | 0.02 | — |
| 4B | 0.25 | 12.4 | 2.7 | 8.2 | 1.3 | — | — | 0.29 | 0.02 | — |
| 4C | 0.20 | 12.4 | 2.1 | 8.2 | 1.3 | — | — | 0.29 | 0.02 | — |
| 4D | 0.19 | 14.2 | 2.8 | 6.8 | 2.4 | 1.3 | — | 0.28 | 0.02 | — |
| 4E | 0.19 | 12.1 | 2.0 | 8.2 | 1.3 | 2.0 | — | 0.28 | 0.02 | — |
| 4F | 0.21 | 14.2 | 2.6 | 8.2 | 1.3 | — | 0.6 | 0.29 | 0.02 | — |
| 4G | 0.26 | 12.6 | 1.7 | 8.5 | 0.29 | — | — | 0.30 | 0.02 | — |
| 5B | 0.24 | 13.0 | 5.1 | 8.9 | 1.7 | — | — | 0.29 | 0.03 | — |
| 5C | 0.25 | 12.2 | 6.2 | 9.0 | 1.3 | — | — | 0.29 | 0.03 | — |
| 5D | 0.22 | 15.3 | 4.6 | 8.5 | 1.5 | 0.5 | — | 0.28 | 0.03 | — |
| 5E | 0.24 | 13.0 | 7.4 | 8.9 | 1.7 | — | — | 0.28 | 0.03 | — |
| 5F | 0.24 | 13.0 | 8.7 | 8.9 | 1.5 | — | — | 0.28 | 0.02 | — |
| 6A | 0.24 | 14.0 | 6.0 | 9.0 | 1.5 | 0.9 | | 0.25 | 0.02 | |
| 6B | 0.22 | 14.0 | 5.4 | 9.0 | 1.0 | 1.5 | | 0.30 | 0.02 | |
| 6C | 0.22 | 14.0 | 7.2 | 9.0 | 1.0 | 1.0 | | 0.30 | 0.02 | |
| 6D | 0.23 | 14.0 | 6.5 | 9.0 | 1.0 | 1.2 | | 0.30 | 0.02 | |
| 6E | 0.23 | 14.1 | 7.0 | 9.1 | 1.0 | 1.0 | | 0.31 | 0.02 | |
| 6F | 0.21 | 14.0 | 5.5 | 10.0 | 2.0 | 1.0 | | 0.30 | 0.02 | |
| 6G | 0.24 | 13.0 | 7.4 | 8.5 | 1.4 | 2.0 | | 0.30 | 0.02 | |
| 6H | 0.23 | 12.5 | 2.8 | 9.0 | 1.3 | 2.75 | | 0.30 | 0.02 | |
| 6I | 0.22 | 14.0 | 5.5 | 8.5 | 2.0 | 1.4 | 0.7 | 0.30 | 0.02 | |
| 6J | 0.21 | 14.0 | 7.5 | 9.0 | 1.0 | 1.0 | | 0.30 | 0.02 | |
| 6K | 0.19 | 14.0 | 8.1 | 9.0 | 1.0 | 1.0 | | 0.30 | 0.02 | |
| 6L | 0.21 | 8.0 | 6.0 | 9.0 | 2.0 | 2.0 | | 0.30 | 0.02 | |
| 6M | 0.20 | 8.0 | 6.0 | 9.0 | 2.0 | 2.0 | 0.7 | 0.30 | 0.02 | |

Note:
All values in % by weight

Example 1

Alloy 1 in TABLE 1 was vacuum induction melted (VIM) to a six inch diameter electrode which was subsequently vacuum arc remelted (VAR) to a eight inch diameter ingot. The material was homogenized for seventy-two hours at 1200° C., forged and annealed according to the preferred processing techniques described above and depicted in FIGS. 2A and 2B. Dilatometer samples were machined and the $M_S$ temperature was measured as 175° C. by quenching dilatometry and 1% transformation fraction.

Test samples were machined, solution heat treated at 1025° C. for one hour, oil quenched, immersed in liquid nitrogen for one hour, warmed to room temperature and tempered at 482° C. for eight hours. The measured properties are listed in TABLE 2 below.

TABLE 2

Various measured properties for Alloy 1

| Property | Value |
|---|---|
| Yield Strength | 205 ksi |
| Ultimate Tensile Strength | 245 ksi |
| Elongation | 10% |
| Reduction of Area | 48% |
| Hardness | 51 HRC |

Example 2

Alloy 2A in TABLE 1 was vacuum induction melted (VIM) to a six inch diameter electrode which was subsequently vacuum arc remelted (VAR) to a eight inch diameter ingot. The ingot was homogenized for twelve hours at 1190° C., forged and rolled to 1.500 inch square bar starting at 1120° C., and annealed according to the preferred processing techniques described above and depicted in FIGS. 2A and 2B. Dilatometer samples were machined and the $M_S$ temperature was measured as 265° C. by quenching dilatometry and 1% transformation fraction.

Test samples were machined from the square bar, solution heat treated at 1050° C. for one hour, oil quenched, immersed in liquid nitrogen for one hour, warmed to room temperature, tempered at 500° C. for five hours, air cooled, immersed in liquid nitrogen for one hour, warmed to room temperature and tempered at 500° C. for five and one-half hours. The measured properties are listed in TABLE 3 below. The reference to the corrosion rate of 15-5PH (H900 condition) was made using a sample tested under identical conditions. The average corrosion rate for 15-5PH (H900 condition) for this test was 0.26 mils per year (mpy).

TABLE 3

Various measured properties for Alloy 2A

| Property | Value |
|---|---|
| Yield Strength | 197 ksi |
| Ultimate Tensile Strength | 259 ksi |
| Elongation | 14% |
| Reduction of Area | 64% |
| Hardness | 51.5 HRC |
| $K_{Ic}$ Fracture Toughness | 41 ksi $\sqrt{in}$ |
| Open Circuit Potential (OCP) | −0.33 V |
| Average Corrosion Rate | 0.52 mpy (200% of 15-5 PH H900 Condition) |
| $K_{Iscc}$ | 25 ksi $\sqrt{in}$ |
| Nitrided Surface Hardness | 1100 HV (70 HRC) |

Tensile samples were machined from the square bar, solution heat treated at 1025° C. for seventy-five minutes, oil quenched, immersed in liquid nitrogen for one hour, warmed to room temperature, multi-step tempered at 496° C. for either four hours or six hours with liquid nitrogen ($LN_2$) treatments for one hour in between the temper steps. The measured tensile properties are listed in TABLE 4 below.

TABLE 4

Measured tensile properties for Alloy 2A

| Temper Treatment | Yield Strength (ksi) | Ultimate Tensile Strength (ksi) | Elongation (%) | Reduction of Area (%) |
|---|---|---|---|---|
| 12 h | 208 | 264 | 17 | 64 |
| 6 h + $LN_2$ + 6 h | 216 | 261 | 17 | 65 |
| 4 h + $LN_2$ + 4 h + $LN_2$ + 4 h | 203 | 262 | 15 | 64 |

Example 3

Alloy 2B in TABLE 1 was vacuum induction melted (VIM) to a six inch diameter electrode which was subsequently vacuum arc remelted (VAR) to a eight inch diameter ingot. The ingot was homogenized for twelve hours at 1190° C., forged and rolled to 1.000 inch diameter round bar starting at 1120° C. and annealed according to the preferred processing techniques described above and depicted in FIGS. 2A and 2B. Dilatometer samples were machined and the $M_S$ temperature was measured as 225° C. by quenching dilatometry and 1% transformation fraction.

Test samples were machined from the round bar, solution heat treated at 1100° C. for 70 minutes, oil quenched, immersed in liquid nitrogen for one hour, warmed to room temperature and tempered at 482° C. for twenty-four hours. The measured properties are listed in TABLE 5 below.

TABLE 5

Various measured properties for Alloy 2B

| Property | Value |
|---|---|
| Yield Strength | 211 ksi |
| Ultimate Tensile Strength | 247 ksi |
| Elongation | 17% |
| Reduction of Area | 62% |
| Hardness | 51 HRC |

Example 4

Alloy 2C in TABLE 1 was vacuum induction melted (VIM) to a six inch diameter electrode which was subsequently vacuum arc remelted (VAR) to a eight inch diameter ingot. The ingot was homogenized for twelve hours at 1190° C., forged to 2.250 inch square bar starting at 1120° C. and annealed according to the preferred processing techniques described above and depicted in FIGS. 2A and 2B. Dilatometer samples were machined and the $M_S$ temperature was measured as 253° C. by quenching dilatometry and 1% transformation fraction.

Test samples were machined from the square bar, solution heat treated at 1025° C. for 75 minutes, oil quenched, immersed in liquid nitrogen for one hour, warmed to room temperature, tempered at 498° C. for eight hours. The measured properties are listed in TABLE 6 below.

TABLE 6

Various measured properties for Alloy 2C

| Property | Value |
|---|---|
| Yield Strength | 221 ksi |
| Ultimate Tensile Strength | 297 ksi |
| Elongation | 12.5% |
| Reduction of Area | 58% |
| Hardness | 55 HRC |
| $K_{Ic}$ Fracture Toughness | 42 ksi $\sqrt{in}$ |

Test samples were machined from the square bar, solution heat treated at 1025° C. for 75 minutes, oil quenched, immersed in liquid nitrogen for one hour, warmed to room temperature, tempered at 498° C. for twelve hours. The measured properties are listed in TABLE 7 below.

TABLE 7

Various measured properties for Alloy 2C

| Property | Value |
|---|---|
| Yield Strength | 223 ksi |
| Ultimate Tensile Strength | 290 ksi |
| Elongation | 13% |
| Reduction of Area | 62% |
| Hardness | 54 HRC |
| $K_{Ic}$ Fracture Toughness | 43 ksi $\sqrt{in}$ |

Corrosion test samples were machined from the square bar, solution heat treated at 1025° C. for 75 minutes, oil quenched, immersed in liquid nitrogen for one hour, warmed to room temperature, tempered at 498° C. for eight hours, air cooled and tempered at 498° C. for four hours. The measured properties are listed in TABLE 8 below. The reference to the corrosion rate of 15-5PH (H900 condition) was made using a sample tested under identical conditions. The average corrosion rate for 15-5PH (H900 condition) for this test was 0.26 mils per year (mpy).

TABLE 8

Various measured properties for Alloy 2C

| Property | Value |
|---|---|
| Open Circuit Potential (OCP) | −0.32 V |
| Average Corrosion Rate | 0.40 mpy (150% of 15-5 PH H900 Condition) |

Tensile samples were machined from the square bar, solution heat treated at 1025° C. for 75 minutes, oil quenched, immersed in liquid nitrogen for one hour, warmed to room temperature, multi-step tempered at 496° C. for either four hours or six hours with liquid nitrogen ($LN_2$) treatments for one hour in between the temper steps. The measured tensile properties are listed in TABLE 9 below.

TABLE 9

Measured tensile properties for Alloy 2C

| Temper Treatment | Yield Strength [ksi] | Ultimate Tensile Strength [ksi] | Elongation [%] | Reduction of Area [%] | Hardness [HRC] |
|---|---|---|---|---|---|
| 12 h | 213 | 293 | 17 | 63 | 55.5 |
| 6 h + $LN_2$ + 6 h | 227 | 295 | 15 | 51 | 56 |
| 4 h + $LN_2$ + 4 h + $LN_2$ + 4 h | 223 | 294 | 18 | 64 | 55.5 |

Example 5

Alloy 3A in TABLE 1 was vacuum induction melted (VIM) to a six inch diameter electrode which was subsequently vacuum arc remelted (VAR) to a eight inch diameter ingot. The ingot was homogenized for twelve hours at 1260° C., forged to 2.250 inch square bar starting at 1090° C. and annealed according to the preferred processing techniques described above and depicted in FIGS. 2A and 2B. Dilatometer samples were machined and the $M_S$ temperature was measured as 250° C. by quenching dilatometry and 1% transformation fraction.

Test samples were machined from the square bar, solution heat treated at 1025° C. for 75 minutes, oil quenched, immersed in liquid nitrogen for one hour, warmed to room temperature, tempered at 510° C. for five hours. The measured properties are listed in TABLE 10 below.

TABLE 10

Various measured properties for Alloy 3A

| Property | Value |
|---|---|
| Yield Strength | 228 ksi |
| Ultimate Tensile Strength | 284 ksi |
| Elongation | 16% |
| Reduction of Area | 60% |
| Hardness | 54 HRC |
| $K_{Ic}$ Fracture Toughness | 37 ksi $\sqrt{in}$ |

Test samples were machined from the square bar, solution heat treated at 1025° C. for 75 minutes, oil quenched, immersed in liquid nitrogen for one hour, warmed to room temperature, multi-step tempered at 510° C. for four hours followed by liquid nitrogen ($LN_2$) treatment for one hour and finally tempered at 510° C. for an additional four hours. The measured properties are listed in TABLE 11 below.

TABLE 11

Various measured properties for Alloy 3A

| Property | Value |
|---|---|
| Yield Strength | 226 ksi |
| Ultimate Tensile Strength | 279 ksi |
| Elongation | 16% |
| Reduction of Area | 61% |
| Hardness | 54 HRC |
| $K_{Ic}$ Fracture Toughness | 38 ksi $\sqrt{in}$ |

Corrosion test samples were machined from the square bar, solution heat treated at 1025° C. for 75 minutes, oil quenched, immersed in liquid nitrogen for one hour, warmed to room temperature, and tempered at 200° C. for one hour. The measured properties are listed in TABLE 12 below. The reference to the corrosion rate of 15-5PH (H900 condition) was made using a sample tested under identical conditions. The average corrosion rate for 15-5PH (H900 condition) for this test was 0.20 mils per year (mpy).

TABLE 12

Various measured properties for Alloy 3A

| Property | Value |
|---|---|
| Open Circuit Potential (OCP) | −0.29 V |
| Average Corrosion Rate | 0.51 mpy (255% of 15-5 PH H900 Condition) |

Corrosion test samples were machined from the square bar, solution heat treated at 1025° C. for 75 minutes, oil quenched, immersed in liquid nitrogen for one hour, warmed to room temperature, and tempered at 510° C. for eight hours. The measured properties are listed in TABLE 13 below.

TABLE 13

Various measured properties for Alloy 3A

| Property | Value |
|---|---|
| Open Circuit Potential (OCP) | −0.26 V |
| Average Corrosion Rate | 0.38 mpy (190% of 15-5 PH H900 Condition) |

Example 6

Alloy 3B in TABLE 1 was vacuum induction melted (VIM) to a six inch diameter electrode which was subsequently vacuum arc remelted (VAR) to a eight inch diameter ingot. The ingot was homogenized for twelve hours at 1260° C., forged to 2.250 inch square bar starting at 1090° C. and annealed according to the preferred processing techniques described above and depicted in FIGS. 2A and 2B. Dilatometer samples were machined and the $M_S$ temperature was measured as 240° C. by quenching dilatometry and 1% transformation fraction.

Test samples were machined from the square bar, solution heat treated at 1025° C. for 75 minutes, oil quenched, immersed in liquid nitrogen for one hour, warmed to room temperature, and finally tempered at 510° C. for five hours. The measured properties are listed in TABLE 14 below.

TABLE 14

Various measured properties for Alloy 3B

| Property | Value |
|---|---|
| Yield Strength | 235 ksi |
| Ultimate Tensile Strength | 288 ksi |
| Elongation | 16% |
| Reduction of Area | 60% |
| Hardness | 54 HRC |
| $K_{Ic}$ Fracture Toughness | 38 ksi $\sqrt{in}$ |

Test samples were machined from the square bar, solution heat treated at 1025° C. for 75 minutes, oil quenched, immersed in liquid nitrogen for one hour, warmed to room temperature, multi-step tempered at 510° C. for four hours followed by liquid nitrogen ($LN_2$) treatment for one hour and finally tempered at 510° C. for an additional four hours. The measured properties are listed in TABLE 15 below.

TABLE 15

Various measured properties for Alloy 3B

| Property | Value |
|---|---|
| Yield Strength | 234 ksi |
| Ultimate Tensile Strength | 281 ksi |
| Elongation | 15% |
| Reduction of Area | 62% |
| Hardness | 54 HRC |
| $K_{Ic}$ Fracture Toughness | 35 ksi $\sqrt{in}$ |

Example 7

Alloy 4A in TABLE 1 was vacuum induction melted (VIM) to a four inch diameter electrode which was subsequently vacuum arc remelted (VAR) to a five inch diameter ingot. The ingot was homogenized for twelve hours at 1250° C., hot rolled to two inch round corner square using frequent reheats at 1015° C., hot rolled to 0.750 inch thick by 2.250 inch wide rectangular bar, normalized and annealed according to the preferred processing techniques described above and depicted in FIGS. 2A and 2B. Dilatometer samples were machined and the $M_S$ temperature was measured as 275° C. by quenching dilatometry and 1% transformation fraction.

Corrosion test samples were machined from the rectangular bar, solution heat treated at 1025° C. for 75 minutes, oil quenched, immersed in liquid nitrogen for one hour, warmed to room temperature, and tempered at 510° C. for twelve hours. The measured properties are listed in TABLE 16 below. The reference to the corrosion rate of 15-5PH (H900 condition) was made using a sample tested under identical conditions. The average corrosion rate for 15-5PH (H900 condition) for this test was 0.20 mils per year (mpy).

TABLE 16

Various measured properties for Alloy 4A

| Property | Value |
|---|---|
| Open Circuit Potential (OCP) | −0.28 V |
| Average Corrosion Rate | 0.45 mpy (225% of 15-5 PH H900 Condition) |

Corrosion test samples were machined from the rectangular bar, solution heat treated at 1025° C. for 75 minutes, oil quenched, immersed in liquid nitrogen for one hour, warmed to room temperature, and tempered at 510° C. for twenty-four hours. The measured properties are listed in TABLE 17 below.

TABLE 17

Various measured properties for Alloy 4A

| Property | Value |
|---|---|
| Hardness | 53 HRC |
| Open Circuit Potential (OCP) | −0.38 V |
| Average Corrosion Rate | 0.88 mpy |

Example 8

Alloy 4B in TABLE 1 was vacuum induction melted (VIM) to a four inch diameter electrode which was subsequently vacuum arc remelted (VAR) to a five inch diameter ingot. The ingot was homogenized for twelve hours at 1250° C., hot rolled to two inch round corner square using frequent reheats at 1015° C., hot rolled to 0.750 inch thick by 2.250 inch wide rectangular bar, normalized and annealed according to the preferred processing techniques described above and depicted in FIGS. 2A and 2B. Dilatometer samples were machined and the $M_S$ temperature was measured as 285° C. by quenching dilatometry and 1% transformation fraction.

Corrosion test samples were machined from the rectangular bar, solution heat treated at 1025° C. for 75 minutes, oil quenched, immersed in liquid nitrogen for one hour, warmed to room temperature, and tempered at 510° C. for twelve hours. The measured properties are listed in TABLE 18 below. The reference to the corrosion rate of 15-5PH (H900 condition) was made using a sample tested under identical conditions. The average corrosion rate for 15-5PH (H900 condition) for this test was 0.20 mils per year (mpy).

TABLE 18

Various measured properties for Alloy 4B

| Property | Value |
|---|---|
| Hardness | 54 HRC |
| Open Circuit Potential (OCP) | −0.33 V |
| Average Corrosion Rate | 1.05 mpy (525% of 15-5 PH H900 Condition) |

Example 9

Alloy 4C in TABLE 1 was vacuum induction melted (VIM) to a four inch diameter electrode which was subsequently vacuum arc remelted (VAR) to a five inch diameter ingot. The ingot was homogenized for twelve hours at 1250° C., hot rolled to two inch round corner square using frequent reheats at 1015° C., hot rolled to 0.750 inch thick by 2.250 inch wide rectangular bar, normalized and annealed according to the preferred processing techniques described above and depicted in FIGS. 2A and 2B. Dilatometer samples were machined and the $M_S$ temperature was measured as 310° C. by quenching dilatometry and 1% transformation fraction.

Test samples were machined from the rectangular bar, solution heat treated at 1025° C. for 75 minutes, oil quenched, immersed in liquid nitrogen for one hour, warmed to room temperature, multi-step tempered at 200° C. for two hours followed by liquid nitrogen ($LN_2$) treatment for one hour and finally tempered at 200° C. for an additional two hours. The measured properties are listed in TABLE 19 below.

TABLE 19

Various measured properties for Alloy 4C

| Property | Value |
|---|---|
| Yield Strength | 197 ksi |
| Ultimate Tensile Strength | 258 ksi |
| Elongation | 11% |
| Reduction of Area | 37% |
| Hardness | 51 HRC |

Example 10

Alloy 4D in TABLE 1 was vacuum induction melted (VIM) to a four inch diameter electrode which was subsequently vacuum arc remelted (VAR) to a five inch diameter ingot. The ingot was homogenized for twelve hours at 1250° C., hot rolled to two inch round corner square using frequent reheats at 1015° C., hot rolled to 0.750 inch thick by 2.250 inch wide rectangular bar, normalized and annealed according to the preferred processing techniques described above and depicted in FIGS. 2A and 2B. Dilatometer samples were machined and the $M_S$ temperature was measured as 300° C. by quenching dilatometry and 1% transformation fraction.

Test samples were machined from the rectangular bar, solution heat treated at 1025° C. for 75 minutes, oil quenched, immersed in liquid nitrogen for one hour, warmed to room temperature, multi-step tempered at 200° C. for two hours followed by liquid nitrogen ($LN_2$) treatment for one hour and finally tempered at 200° C. for an additional two hours. The measured properties are listed in TABLE 20 below.

TABLE 20

Various measured properties for Alloy 4D

| Property | Value |
|---|---|
| Yield Strength | 199 ksi |
| Ultimate Tensile Strength | 263 ksi |
| Elongation | 13% |
| Reduction of Area | 17% |
| Hardness | 53 HRC |

Corrosion test samples were machined from the rectangular bar, solution heat treated at 1000° C. for 75 minutes, oil quenched, immersed in liquid nitrogen for one hour, warmed to room temperature, and tempered at 510° C. for twelve hours. The measured properties are listed in TABLE 21 below. The reference to the corrosion rate of 15-5PH (H900 condition) was made using a sample tested under identical conditions. The average corrosion rate for 15-5PH (H900 condition) for this test was 0.20 mils per year (mpy).

TABLE 21

Various measured properties for Alloy 4D

| Property | Value |
|---|---|
| Open Circuit Potential (OCP) | −0.35 V |
| Average Corrosion Rate | 1.12 mpy (560% of 15-5 PH H900 Condition) |

Example 11

Alloy 4E in TABLE 1 was vacuum induction melted (VIM) to a four inch diameter electrode which was subsequently vacuum arc remelted (VAR) to a five inch diameter ingot. The ingot was homogenized for twelve hours at 1250° C., hot rolled to two inch round corner square using frequent reheats at 1015° C., hot rolled to 0.750 inch thick by 2.250 inch wide rectangular bar, normalized and annealed according to the preferred processing techniques described above and depicted in FIGS. 2A and 2B. Dilatometer samples were machined and the $M_S$ temperature was measured as 300° C. by quenching dilatometry and 1% transformation fraction.

Example 12

Alloy 4F in TABLE 1 was vacuum induction melted (VIM) to a four inch diameter electrode which was subsequently vacuum arc remelted (VAR) to a five inch diameter ingot. The ingot was homogenized for twelve hours at 1250° C., hot rolled to two inch round corner square using frequent reheats at 1015° C., hot rolled to 0.750 inch thick by 2.250 inch wide rectangular bar, normalized and annealed according to the preferred processing techniques described above and depicted in FIGS. 2A and 2B. Dilatometer samples were machined and the $M_S$ temperature was measured as 300° C. by quenching dilatometry and 1% transformation fraction.

Test samples were machined from the rectangular bar, solution heat treated at 1025° C. for 75 minutes, oil quenched, immersed in liquid nitrogen for one hour, warmed to room temperature, multi-step tempered at 200° C. for two hours followed by liquid nitrogen ($LN_2$) treatment for one hour and finally tempered at 200° C. for an additional two hours. The measured properties are listed in TABLE 22 below.

TABLE 22

Various measured properties for Alloy 4F

| Property | Value |
|---|---|
| Yield Strength | 202 ksi |
| Ultimate Tensile Strength | 267 ksi |
| Elongation | 11% |
| Reduction of Area | 15% |
| Hardness | 51 HRC |

Corrosion test samples were machined from the rectangular bar, solution heat treated at 1000° C. for 75 minutes, oil quenched, immersed in liquid nitrogen for one hour, warmed to room temperature, and tempered at 510° C. for twelve hours. The measured properties are listed in TABLE 23 below. The reference to the corrosion rate of 15-5PH (H900 condition) was made using a sample tested under identical conditions. The average corrosion rate for 15-5PH (H900 condition) for this test was 0.20 mils per year (mpy).

TABLE 23

Various measured properties for Alloy 4F

| Property | Value |
|---|---|
| Open Circuit Potential (OCP) | −0.33 V |
| Average Corrosion Rate | 0.62 mpy (310% of 15-5 PH H900 Condition) |

Example 13

Alloy 4G in TABLE 1 was vacuum induction melted (VIM) to a four inch diameter electrode which was subsequently vacuum arc remelted (VAR) to a five inch diameter ingot. The ingot was homogenized for twelve hours at 1250° C., hot rolled to two inch round corner square using frequent reheats at 1015° C., hot rolled to 0.750 inch thick by 2.250 inch wide rectangular bar, normalized and annealed according to the preferred processing techniques described above and depicted in FIGS. 2A and 2B. Dilatometer samples were machined and the $M_S$ temperature was measured as 320° C. by quenching dilatometry and 1% transformation fraction.

Example 14

Alloy 5B in TABLE 1 was vacuum induction melted (VIM) to a four inch diameter electrode which was subsequently vacuum arc remelted (VAR) to a five inch diameter ingot. The ingot was homogenized for twelve hours at 1250° C., hot rolled to two inch round corner square using frequent reheats at 1015° C., hot rolled to 0.750 inch thick by 2.250 inch wide rectangular bar, normalized and annealed according to the preferred processing techniques described above and depicted in FIGS. 2A and 2B. Dilatometer samples were machined and the $M_S$ temperature was measured as 200° C. by quenching dilatometry and 1% transformation fraction.

Test samples were machined from the rectangular bar, solution heat treated at 1025° C. for 75 minutes, oil quenched, immersed in liquid nitrogen for one hour, warmed to room temperature, multi-step tempered at 468° C. for twenty-four hours followed by liquid nitrogen ($LN_2$) treatment for one hour and finally tempered at 468° C. for an additional twenty-four hours. The measured properties are listed in TABLE 24 below.

TABLE 24

Various measured properties for Alloy 5B

| Property | Value |
|---|---|
| Yield Strength | 204 ksi |
| Ultimate Tensile Strength | 265 ksi |
| Elongation | 16% |
| Reduction of Area | 63% |
| Hardness | 52 HRC |

Test samples were machined from the rectangular bar, solution heat treated at 1025° C. for 75 minutes, oil quenched, immersed in liquid nitrogen for one hour, warmed to room temperature, multi-step tempered at 468° C. for thirty-six hours followed by liquid nitrogen ($LN_2$) treatment for one hour and finally tempered at 468° C. for an additional thirty-six hours. The measured properties are listed in TABLE 25 below.

TABLE 25

Various measured properties for Alloy 5B

| Property | Value |
|---|---|
| Yield Strength | 211 ksi |
| Ultimate Tensile Strength | 294 ksi |
| Elongation | 15% |
| Reduction of Area | 55% |
| Hardness | 55 HRC |

Example 15

Alloy 5C in TABLE 1 was vacuum induction melted (VIM) to a four inch diameter electrode which was subsequently vacuum arc remelted (VAR) to a five inch diameter ingot. The ingot was homogenized for twelve hours at 1250° C., hot rolled to two inch round corner square using frequent reheats at 1015° C., hot rolled to 0.750 inch thick by 2.250 inch wide rectangular bar, normalized and annealed according to the preferred processing techniques described above and depicted in FIGS. 2A and 2B. Dilatometer samples were machined and the $M_S$ temperature was measured as 180° C. by quenching dilatometry and 1% transformation fraction.

Test samples were machined from the rectangular bar, solution heat treated at 1025° C. for 75 minutes, oil quenched, immersed in liquid nitrogen for one hour, warmed to room temperature, multi-step tempered at 468° C. for sixteen hours followed by liquid nitrogen ($LN_2$) treatment for one hour and finally tempered at 468° C. for an additional sixteen hours. The measured properties are listed in TABLE 26 below.

TABLE 26

Various measured properties for Alloy 5C

| Property | Value |
|---|---|
| Yield Strength | 204 ksi |
| Ultimate Tensile Strength | 261 ksi |
| Elongation | 16% |
| Reduction of Area | 63% |
| Hardness | 49 HRC |

Example 16

Alloy 5D in TABLE 1 was vacuum induction melted (VIM) to a four inch diameter electrode which was subsequently vacuum arc remelted (VAR) to a five inch diameter ingot. The ingot was homogenized for twelve hours at 1250° C., hot rolled to two inch round corner square using frequent reheats at 1015° C., hot rolled to 0.750 inch thick by 2.250 inch wide rectangular bar, normalized and annealed according to the preferred processing techniques described above and depicted in FIGS. 2A and 2B. Dilatometer samples were machined and the $M_S$ temperature was measured as 240° C. by quenching dilatometry and 1% transformation fraction.

Test samples were machined from the rectangular bar, solution heat treated at 1025° C. for 75 minutes, oil quenched, immersed in liquid nitrogen for one hour, warmed to room temperature, multi-step tempered at 468° C. for twenty-four hours followed by liquid nitrogen ($LN_2$) treatment for one hour and finally tempered at 468° C. for an additional twenty-four hours. The measured properties are listed in TABLE 27 below.

TABLE 27

| Various measured properties for Alloy 5D | |
|---|---|
| Property | Value |
| Yield Strength | 228 ksi |
| Ultimate Tensile Strength | 276 ksi |
| Elongation | 16% |
| Reduction of Area | 61% |
| Hardness | 53 HRC |

Test samples were machined from the rectangular bar, solution heat treated at 1025° C. for 75 minutes, oil quenched, immersed in liquid nitrogen for one hour, warmed to room temperature, and finally tempered at 468° C. for twenty-eight hours. The measured properties are listed in TABLE 28 below.

TABLE 28

| Various measured properties for Alloy 5D | |
|---|---|
| Property | Value |
| Yield Strength | 225 ksi |
| Ultimate Tensile Strength | 300 ksi |
| Elongation | 14% |
| Reduction of Area | 46% |
| Hardness | 55 HRC |

Test samples were machined from the rectangular bar, solution heat treated at 1025° C. for 75 minutes, oil quenched, immersed in liquid nitrogen for one hour, warmed to room temperature, and finally tempered at 468° C. for seventy-two hours. The measured properties are listed in TABLE 29 below.

TABLE 29

| Various measured properties for Alloy 5D | |
|---|---|
| Property | Value |
| Yield Strength | 233 ksi |
| Ultimate Tensile Strength | 294 ksi |
| Elongation | 14% |
| Reduction of Area | 11% |
| Hardness | 54 HRC |

Example 17

Alloy 5E in TABLE 1 was vacuum induction melted (VIM) to a four inch diameter electrode which was subsequently vacuum arc remelted (VAR) to a five inch diameter ingot. The ingot was homogenized for twelve hours at 1250° C., hot rolled to two inch round corner square using frequent reheats at 1015° C., hot rolled to 0.750 inch thick by 2.250 inch wide rectangular bar, normalized and annealed according to the preferred processing techniques described above and depicted in FIGS. 2A and 2B. Dilatometer samples were machined and the $M_S$ temperature was measured as 165° C. by quenching dilatometry and 1% transformation fraction.

Test samples were machined from the rectangular bar, solution heat treated at 1025° C. for 75 minutes, oil quenched, immersed in liquid nitrogen for one hour, warmed to room temperature, multi-step tempered at 468° C. for sixteen hours followed by liquid nitrogen ($LN_2$) treatment for one hour and finally tempered at 468° C. for an additional sixteen hours. The measured properties are listed in TABLE 30 below.

TABLE 30

| Various measured properties for Alloy 5E | |
|---|---|
| Property | Value |
| Yield Strength | 224 ksi |
| Ultimate Tensile Strength | 260 ksi |
| Elongation | 16% |
| Reduction of Area | 59% |
| Hardness | 50 HRC |

Test samples were machined from the rectangular bar, solution heat treated at 1025° C. for 75 minutes, oil quenched, immersed in liquid nitrogen for one hour, warmed to room temperature, multi-step tempered at 468° C. for twenty-four hours followed by liquid nitrogen ($LN_2$) treatment for one hour and finally tempered at 468° C. for an additional twenty-four hours. The measured properties are listed in TABLE 31 below.

TABLE 31

| Various measured properties for Alloy 5E | |
|---|---|
| Property | Value |
| Yield Strength | 233 ksi |
| Ultimate Tensile Strength | 291 |
| Elongation | 13% |
| Reduction of Area | 51% |
| Hardness | 55 HRC |

Test samples were machined from the rectangular bar, solution heat treated at 1025° C. for 75 minutes, oil quenched, immersed in liquid nitrogen for one hour, warmed to room temperature, multi-step tempered at 468° C. for fourteen hours followed by liquid nitrogen ($LN_2$) treatment for one hour and finally tempered at 468° C. for fourteen hours. The measured properties are listed in TABLE 32 below.

TABLE 32

| Various measured properties for Alloy 5E | |
|---|---|
| Property | Value |
| Yield Strength | 218 ksi |
| Ultimate Tensile Strength | 294 ksi |
| Elongation | 14% |
| Reduction of Area | 47% |
| Hardness | 55 HRC |

Example 18

Alloy 5F in TABLE 1 was vacuum induction melted (VIM) to a four inch diameter electrode which was subsequently vacuum arc remelted (VAR) to a five inch diameter ingot. The ingot was homogenized for twelve hours at 1250° C., hot rolled to two inch round corner square using frequent reheats at 1015° C., hot rolled to 0.750 inch thick by 2.250 inch wide rectangular bar, normalized and annealed according to the preferred processing techniques described above and depicted in FIGS. 2A and 2B. Dilatometer samples were machined and the $M_S$ temperature was measured to be lower than 25° C. by quenching dilatometry and 1% transformation fraction.

Test samples were machined from the rectangular bar, solution heat treated at 1025° C. for 75 minutes, oil quenched, immersed in liquid nitrogen for one hour, warmed to room temperature, multi-step tempered at 468° C. for sixteen hours followed by liquid nitrogen ($LN_2$) treatment for one hour and finally tempered at 468° C. for an additional sixteen hours. The measured properties are listed in TABLE 33 below.

TABLE 33

| Various measured properties for Alloy 5F | |
|---|---|
| Property | Value |
| Yield Strength | 234 ksi |
| Ultimate Tensile Strength | 254 ksi |
| Elongation | 14% |
| Reduction of Area | 62% |
| Hardness | 49 HRC |

Test samples were machined from the rectangular bar, solution heat treated at 1025° C. for 75 minutes, oil quenched, immersed in liquid nitrogen for one hour, warmed to room temperature, and finally tempered at 468° C. for twenty-eight hours. The measured properties are listed in TABLE 34 below.

TABLE 34

| Various measured properties for Alloy 5F | |
|---|---|
| Property | Value |
| Yield Strength | 168 ksi |
| Ultimate Tensile Strength | 265 ksi |
| Elongation | 14% |
| Reduction of Area | 52% |
| Hardness | 50 HRC |

Test samples were machined from the rectangular bar, solution heat treated at 1025° C. for 75 minutes, oil quenched, immersed in liquid nitrogen for one hour, warmed to room temperature, and finally tempered at 468° C. for forty-eight hours. The measured properties are listed in TABLE 35 below.

TABLE 35

| Various measured properties for Alloy 5F | |
|---|---|
| Property | Value |
| Yield Strength | 168 ksi |
| Ultimate Tensile Strength | 246 ksi |
| Elongation | 15% |
| Reduction of Area | 57% |
| Hardness | 49 HRC |

The examples of Tables 34 and 35 illustrate the benefits of multi-step tempering of the alloys to provide higher strength.

Important to the alloy design is the achievement of efficient strengthening while maintaining corrosion resistance and effective hydrogen trapping for stress-corrosion resistance. All of these attributes are promoted by refinement of the strengthening $M_2C$ carbide particle size to an optimal size of about three nanometers at the completion of precipitation. FIG. 7 shows the atomic-scale imaging of a three nanometer $M_2C$ carbide in the optimally heat treated alloy 2C using three-dimensional Atom-Probe microanalysis [M. K. Miller, Atom Probe Tomography, Kluwer Academic/Plenum Publishers, New York, N.Y., 2000] which is incorporated herewith, verifying that the designed size and particle composition have in fact been achieved. This image is an atomic reconstruction of a slab of the alloy where each atom is represented by a dot on the figure with a color and size corresponding to its element. The drawn circle in FIG. 7 represents the congregation of alloy carbide formers and carbon which define the $M_2C$ nanoscale carbide in the image.

As a consequence, the alloys discovered have a range of combinations of elements as set forth in TABLE 36.

TABLE 36

| All values in % by weight | | | | | | |
|---|---|---|---|---|---|---|
| C | Co | Ni | Cr | Si | Mn | Cu |
| 0.1 to 0.3 | 8 to 17 | 0 to 10 | 6 to 11 | <1 | <0.5 | <0.15 |
| With one or more of: | | | | | | |
| Mo | Nb | V | Ta | W | | |
| <3 | <0.3 | <0.8 | <0.2 | <3 | | |
| And one or more of: | | | | | | |
| Ti | La or other rare earths | Zr | B | | | |
| <0.2 | <0.2 | <0.15 | <0.005 | | | |
| And the balance Fe | | | | | | |

Preferably, impurities are avoided; however, some impurities and incidental elements are tolerated and within the scope of the invention. Thus, by weight, most preferably, S is less than 0.02%, P less than 0.012%, 0 less than 0.015% and N less than 0.015%. The microstructure is primarily martensitic when processed as described and desirably is maintained as lath martensitic with less than 2.5% and preferably less than 1% by volume, retained or precipitated austenite. The microstructure is primarily inclusive of $M_2C$ nanoscale carbides where M is one or more element selected from the group including Mo, Nb, V, Ta, W and Cr. The formula, size and presence of the carbides are important. Preferably, the carbides are present only in the form of $M_2C$ and to some extent, MC carbides, without the presence of other carbides and the size (average diameter) is less than about ten nanometers and preferably in the range of about three nanometers to five nanometers. Specifically avoided are other larger scale incoherent carbides such as cementite, $M_{23}C_6$, $M_6C$ and $M_7C_3$. Other embrittling phases, such as topologically close packed (TCP) intermetallic phases, are also avoided.

The martensitic matrix in which the strengthening nanocarbides are embedded contains an optimum balance of Co and Ni to maintain a sufficiently high $M_S$ temperature with sufficient Co to enhance Cr partitioning to the passivating oxide film, enhance $M_2C$ driving force and maintain dislocation nucleation of nanocarbides. Resistance to cleavage is enhanced by maintaining sufficient Ni and promoting grain refinement through stable MC carbide dispersions which resist coarsening at the normalizing or solution treatment temperature. Alloy composition and thermal processing are optimized to minimize or eliminate all other dispersed particles that limit toughness and fatigue resistance. Resistance to hydrogen stress corrosion is enhanced by grain boundary segregation of cohesion enhancing elements such as B, Mo and W, and through the hydrogen trapping effect of the nanoscale $M_2C$ carbide dispersion. Alloy composition is constrained to limit microsegregation under production-scale ingot solidification conditions.

The specific alloy compositions of TABLE 1 represent the presently known preferred and optimal formulations in this class of alloys, it being understood that variations of formulations consistent with the physical properties described, the processing steps and within the ranges disclosed as well as equivalents are within the scope of the invention. These preferred embodiments can be summarized as seven subclasses of alloy compositions presented in TABLE 37. Subclass 1 is similar in composition to alloys 2C, 3A and 3B of TABLE 1 and is optimal for a secondary hardening temper at about 400° C. to 600° C. to precipitate Cr—Mo base $M_2C$ carbides providing a UTS in the range of about 270 ksi to 300 ksi. Subclass 2 is similar in composition to alloys 4D and 4E of TABLE 1 and includes additions of W and/or Si to destabilize cementite and provide greater thermal stability with a secondary hardening temper at about 400° C. to 600° C. to precipitate Cr—Mo—W base $M_2C$ carbides. For applications requiring higher fracture toughness, subclass 3 is similar in composition to alloys 1, 2A and 2B in TABLE 1 and provides an intermediate UTS range of about 240 ksi to 270 ksi. Subclass 4 is similar in composition to alloys 4F and 4G of TABLE 1 and is optimal for low-temperature tempering at about 200° C. to 300° C. to precipitate Fe-base $M_2C$ carbides without the precipitation of cementite. Alloy subclass 5 is a most preferred embodiment of subclass 1. Subclass 6 is similar in composition to alloys 5B through 5F and 6A through 6K. Subclass 6 provides optimal toughness due to the higher Ni content but may require multiple tempering treatments with cryogenic treatments between steps in order to avoid significant amounts of retained austenite in the final microstructure. Subclass 7 is a further optimization of fracture toughness and is similar to alloys 6L and 6M where the lower Co content lowers the ductile to brittle transition temperature of the alloy.

TABLE 37

All values in % by weight

| Alloy subclass | C | Co | Ni | Cr | Mo | W | Si | V | Ti |
|---|---|---|---|---|---|---|---|---|---|
| 1 | 0.20 to 0.26 | 11 to 15 | 2.0 to 3.0 | 7.5 to 9.5 | 1.0 to 2.0 | <0.1 | <0.25 | 0.1 to 0.5 | 0.01 to 0.05 |
| 2 | 0.20 to 0.25 | 12 to 15 | 2.0 to 3.0 | 7.0 to 9.0 | 1.0 to 3.0 | <2.5 | <0.75 | 0.1 to 0.5 | 0.01 to 0.05 |
| 3 | 0.10 to 0.20 | 12 to 17 | 2.5 to 5.0 | 8.5 to 9.5 | 1.0 to 2.0 | <0.1 | <0.25 | 0.1 to 0.5 | 0.01 to 0.05 |
| 4 | 0.25 to 0.28 | 11 to 15 | 1.0 to 3.0 | 7.0 to 9.0 | <1.0 | <0.1 | <1.0 | 0.1 to 0.5 | 0.01 to 0.05 |
| 5 | 0.22 to 0.25 | 12 to 13 | 2.5 to 3.0 | 8.5 to 9.5 | 1.0 to 1.5 | <0.1 | <0.25 | 0.1 to 0.5 | 0.01 to 0.05 |
| 6 | 0.18 to 0.25 | 10 to 15 | 4.0 to 8.0 | 8.0 to 10.0 | 1.0 to 3.0 | <3.0 | <1.0 | 0.1 to 0.5 | 0.01 to 0.05 |
| 7 | 0.18 to 0.25 | 6 to 10 | 4.0 to 8.0 | 8.0 to 10.0 | 1.0 to 3.0 | <3.0 | <1.0 | 0.1 to 0.5 | 0.01 to 0.05 |

Therefore, the invention including the class of ultrahigh-strength, corrosion resistant, structural steel alloys and the processes for making and using such alloys is to be limited only by the following claims and equivalents thereof.

What is claimed is:

1. A method of producing a structural, stainless steel alloy comprising the steps of:

(a) combining a mixture in weight percent in a melt of about 0.15 to 0.30% carbon (C), about 8 to 17% cobalt (Co), about 2.0 to 10.0% nickel (Ni), about 8.0 to 11.0% chromium (Cr), about 1.0 to 3.0% molybdenum (Mo), less than about 0.8% vanadium (V), and less than about 3% tungsten (W), the balance essentially iron (Fe) and incidental elements and impurities; and (b) processing said melt mixture to form an article of manufacture characterized in that the alloy has a predominantly lath martensite microstructure essentially without topologically close packed intermetallic phases and said carbon (C) is in predominantly a dispersion of nanoscale, $M_2C$ carbide particles having a nominal dimension less than about 10 nanometers in diameter, where M is two or more elements selected from the group consisting of Cr, Mo, W, V, Nb and Ta, and the alloy is processed to an ultimate tensile strength greater than about 260 ksi.

2. The method of claim 1 wherein M comprises Cr and Mo.

3. The method of claim 1 wherein M comprises Cr, Mo and V.

4. The method of claim 1 wherein cementite dissolution is effectively complete.

5. The method of claim 1 wherein no more than about 10% of the carbon content of the alloy is found in primary MC carbides larger than about ten nanometers, where M is selected from the group consisting of Ti, V, Nb, Mo, Ta and combinations thereof.

6. The method of claim 1 wherein no more than about 5% of the carbon content of the alloy is found in MC carbides larger than about ten nanometers, and M is selected from the group consisting of Cr, Mo, V, W, Nb, Ta, Ti and combinations thereof.

7. The method of claim 1 wherein processing said melt comprises the steps of:

(a) casting said alloy;

(b) homogenizing said alloy;

(c) hot working said alloy; and (d) annealing said alloy.

8. The method of claim 7 wherein said homogenizing is at a metal alloy temperature of about 1100° C. to 1400° C. for at least about four hours.

9. The method of claim 7 wherein said hot working is at a metal alloy temperature of about 840° C. to 1300° C.

10. The method of claim 7 wherein said annealing is at a metal alloy temperature of about 650° C. to 790° C. for more than about one hour.

11. The method of claim 7 including the step of normalizing said alloy subsequent to hot working.

12. The method of claim 11 wherein said normalizing is at a metal alloy temperature of about 880° C. to 1080° C.

13. The method of claim 7 including the additional steps of:
(a) solution heat treating said alloy;
(b) cooling said alloy; and
(c) tempering said alloy.

14. The method of claim 13 wherein said solution heat treating is at a metal temperature of about 850° C. to 1100° C.

15. The method of claim 13 wherein said cooling is to about less than 70° C.

16. The method of claim 13 including the step of a cryogenic treatment subsequent to said cooling.

17. The method of claim 16 wherein said cryogenic treatment is at a metal temperature of below about −70° C.

18. The method of claim 13 wherein said tempering is one or more steps at a metal alloy temperature of less than about 600° C.

19. The method of claim 18 wherein each said tempering step is followed by a cool to a cryogenic temperature of below about −70° C.

20. A method of producing a structural, stainless steel alloy comprising the steps of:
(a) combining a mixture in weight percent in a melt of about 0.15 to 0.30% carbon (C). about 8 to 17% cobalt (Co), about 2.0 to 10.0% nickel (Ni), about 8.0 to 11.0% chromium (Cr), about 1.0 to 3.0% molybdenum (Mo), less than about 0.8% vanadium (V), and less than about 3% tungsten (W), the balance essentially iron (Fe) and incidental elements and impurities; and
(b) processing said melt mixture to form an article of manufacture characterized in that the alloy has a predominantly lath martensite microstructure essentially without topologically close packed intermetallic phases and said carbon (C) is in predominantly a dispersion of nanoscale, $M_2C$ carbide particles having a nominal dimension less than about 10 nanometers in diameter, where M is two or more elements selected from the group consisting of Cr, Mo, W, V, Nb and Ta, and the alloy is processed to a toughness to strength ratio ($K_{IC}$/YS) equal to or greater than about 0.21 √in where $K_{IC}$ is the plane strain fracture toughness and YS is the yield strength.

21. The method of claim 20 wherein cementite dissolution is effectively complete.

22. The method of claim 20 wherein no more than about 10% of the carbon content of the alloy is found in primary MC carbides larger than about ten nanometers, where M is selected from the group consisting of Ti, V, Nb, Mo Ta and combinations thereof.

23. A method of producing a structural, stainless steel alloy comprising the steps of:
(a) combining a mixture in weight percent in a melt of about 0.15 to 0.3% carbon (C); about 8 to 17% cobalt (Co); about 2.0 to 10% nickel (Ni); about 8 to 11% chromium (Cr); about 1.0 to 3% molybdenum (Mo); tungsten (W) and vanadium (V), the molybdenum (Mo) being present in an amount by weight greater than about 1.0 and less than about 3%, the tungsten (W) being present in an amount by weight less than about 3% and the vanadium being present in an amount by weight less than about 0.8%, the balance essentially iron (Fe) and incidental elements and impurities; and
(b) processing said melt mixture to an article of manufacture characterized in that the steel alloy comprises a corrosion resistant, lath martensitic microstructure essentially without topologically close packed intermetalic phases and said carbon (C) is predominantly in a dispersion of nanoscale, $M_2C$ carbide particles having a diameter of 10 nm or less where M comprises Mo and one or more elements selected from the group consisting of Cr, W and V and wherein cementite dissolution is effectively complete.

24. The method of claim 23 processed to a toughness to strength ratio ($K_{IC}$/YS) equal to or greater than about 0.21 √in where $K_{IC}$ is the plane strain fracture toughness and YS is the yield strength.

25. The method of claim 24 processed to a tensile strength greater than about 260 ksi and a toughness to strength ratio ($K_{IC}$/YS) equal to or greater than about 0.21 √in where $K_{IC}$ is the plane strain fracture toughness and YS is yield strength.

26. The method of claim 23 wherein processing said melt comprises the steps of:
(a) casting said alloy;
(b) homogenizing said alloy;
(c) hot working said alloy; and
(d) annealing said alloy.

27. The method of claim 26 wherein said homogenizing is at a metal alloy temperature of about 1100° C. to 1400° C. for at least about four hours.

28. The method of claim 26 wherein said hot working is at a metal alloy temperature of about 840° C. to 1300° C.

29. The method of claim 26 wherein said annealing is at a metal alloy temperature of about 650° C. to 790° C. for more than about one hour.

30. The method of claim 26 including the step of normalizing said alloy subsequent to hot working.

31. The method of claim 30 wherein said normalizing is at a metal alloy temperature of about 880° C. to 1080° C.

32. The method of claim 26 including the additional steps of:
(a) solution heat treating said alloy;
(b) cooling said alloy; and
(c) tempering said alloy.

33. The method of claim 32 wherein said solution heat treating is at a metal temperature of about 850° C. to 1100° C.

34. The method of claim 32 wherein said cooling is to about less than 70° C.

35. The method of claim 32 including the step of a cryogenic treatment subsequent to said cooling.

36. The method of claim 35 wherein said cryogenic treatment is at a metal temperature of below about −70° C.

37. The method of claim 32 wherein said tempering is one or more steps at a metal alloy temperature of less than about 600° C.

38. The method of claim 37 wherein each said tempering step is followed by a cool to a cryogenic temperature of below about −70° C.

39. A method of producing a stainless, structural steel alloy comprising the steps of:
(a) combining a mixture in weight percent in a melt of about 0.15 to 0.30% carbon (C), about 8 to 17% cobalt (Co), about 2.0 to less than 10.0% nickel (Ni), about 8.0 to 11.0% chromium (Cr), about 1.0 to 3.0% molybdenum (Mo), less than about 0.8% vanadium (V), and less than about 3% tungsten (W), the balance essentially iron (Fe) and incidental elements and impurities; and
(b) processing said melt mixture to form an article of manufacture characterized in that the alloy has a predominantly lath martensite microstructure essentially without topologically close packed intermetallic phase and said carbon (C) is predominantly in a dispersion of nanoscale, $M_2C$ carbide particles having a nominal dimension less than about 10 nanometers in diameter, where M is two or more elements selected from the group consisting of Cr, Mo, W and V, and having an ultimate tensile strength greater than about 260 ksi.

40. The method of claim 39 processed to a toughness to strength ratio ($K_{IC}$/YS) equal to or greater than about 0.21 √in where $K_{IC}$ is the plane strain fracture toughness and YS is yield strength.

41. The method of claim 39 wherein cementite dissolution is effectively complete.

42. The method of claim 39 wherein $M_2C$ accounts for about at least 85% of the carbon (C) content in the alloy.

43. The method of claim 39 wherein no more than about 10% of the carbon content of the alloy is found in primary MC carbides larger than about ten nanometers, where M is selected from the group consisting of Ti, V, Nb, Mo, Ta and combinations thereof

44. The method of claim 39 wherein no more than about 5% of the carbon content of the alloy is found in MC carbides larger than about ten nanometers, and M is selected from the group consisting of Cr, Mo, V, W, Nb, Ta, Ti and combinations thereof.

45. The method of claim 39 wherein processing said melt comprises the steps of:

(a) casting said alloy;

(b) homogenizing said alloy;

(c) hot working said alloy; and (d) annealing said alloy.

46. The method of claim 45 wherein said homogenizing is at a metal alloy temperature of about 1100° C. to 1400° C. for at least about four hours.

47. The method of claim 45 wherein said hot working is at a metal alloy temperature of about 840° C. to 1300° C.

48. The method of claim 45 wherein said annealing is at a metal alloy temperature of about 650° C. to 790° C. for more than about one hour.

49. The method of claim 45 including the step of normalizing said alloy subsequent to hot working.

50. The method of claim 49 wherein said normalizing is at a metal alloy temperature of about 880° C. to 1080° C.

51. The method of claim 45 including the additional steps of:

(a) solution heat treating said alloy;

(b) cooling said alloy; and (c) tempering said alloy.

52. The method of claim 51 wherein said solution heat treating is at a metal temperature of about 850° C. to 1100° C.

53. The method of claim 51 wherein said cooling is to about less than 70° C.

54. The method of claim 51 including the step of a cryogenic treatment subsequent to said cooling.

55. The method of claim 54 wherein said cryogenic treatment is at a metal temperature of below about −70° C.

56. The method of claim 51 wherein said tempering is one or more steps at a metal alloy temperature of less than about 600° C.

57. The method of claim 56 wherein each said tempering step is followed by a cool to a cryogenic temperature of below about −70° C.

58. A method of producing a stainless. structural steel alloy comprising the steps of:

(a) combining a mixture in weight percent in a melt of about 0.15 to 0.30% carbon (C), about 8 to 17% cobalt (Co), about 2.0 to less than 10.0% nickel (Ni), about 8.0 to 11.0% chromium (Cr), about 1.0 to 3.0% molybdenum (Mo), less than about 0.8% vanadium (V), and less than about 3% tungsten (W). the balance essentially iron (Fe) and incidental elements and impurities; and (b) processing said melt mixture to form an article of manufacture characterized in that the alloy has a predominantly lath martensite microstructure essentially without topologically close packed intermetallic phases and said carbon (C) is predominantly in a dispersion of nanoscale, $M_2C$ carbide particles having a nominal dimension less than about 10 nanometers in diameter, where M is two or more elements selected from the group consisting of Cr, Mo, W and V, processed to a toughness to strength ratio ($K_{IC}$/YS) equal to or greater than about 0.21 √in where $K_{IC}$ is the plane strain fracture toughness and YS is the yield strength.

59. The method of claim 58 wherein cementite dissolution is effectively complete.

60. The method of claim 58 wherein no more than about 10% of the carbon content of the alloy is found in primary MC carbides larger than about ten nanometers, where M is selected from the group consisting of Ti, V, Nb, Mo Ta and combinations thereof.

61. The method of claim 58 wherein cementite dissolution is effectively complete.

62. The method of claim 58 wherein $M_2C$ accounts for about at least 85% of the carbon (C) content in the alloy.

63. The method of claim 58 wherein no more than about 10% of the carbon content of the alloy is found in primary MC carbides larger than about ten nanometers, where M is selected from the group consisting of Ti, V, Nb, Mo, Ta and combinations thereof.

64. The method of claim 58 wherein no more than about 5% of the carbon content of the alloy is found in MC carbides larger than about ten nanometers, and M is selected from the group consisting of Cr, Mo, V, W, Nb, Ta, Ti and combinations thereof.

65. The method of claim 58 wherein processing said melt comprises the steps of:

(a) casting said alloy;

(b) homogenizing said alloy;

(c) hot working said alloy; and (d) annealing said alloy.

66. The method of claim 65 including the additional steps of (a) solution heat treating said alloy;

(b) cooling said alloy; and (c) tempering said alloy.

67. A method of producing a structural, stainless steel alloy comprising the steps of:

(a) combining a mixture in weight percent in a melt of about 0.15 to 0.30% carbon (C), about 8 to 17% cobalt (Co), about 2.0 to 10.0% nickel (Ni), about 8.0 to 11.0% chromium (Cr), about 1.0 to 3.0% molybdenum (Mo), less than about 0.8% vanadium (V), and less than about 3% tungsten (W), the balance essentially iron (Fe) and incidental elements and impurities; and (b) processing said melt mixture to form an article of manufacture characterized in that the alloy has a predominantly lath martensite microstructure essentially without topologically close packed intermetallic phases and said carbon (C) is in predominantly a dispersion of nanoscale, $M_2C$ carbide particles having a nominal dimension less than about 10 nanometers in diameter, where M is two or more elements selected from the group consisting of Cr, Mo, W, V, Nb and Ta, said processing said melt comprising the steps of:

i. casting said alloy;

ii. homogenizing said alloy;

iii. hot working said alloy;

iv. annealing said alloy v. solution heat treating said alloy;

vi. cooling said alloy; and vii. tempering said alloy in one or more steps at a metal alloy temperature of less then about 600° C., each said tempering step followed by a cool to a cryogenic temperature of below about −70° C.

* * * * *